United States Patent [19]

Bernsten, Jr.

[11] Patent Number: 5,059,453

[45] Date of Patent: Oct. 22, 1991

[54] METHOD AND APPARATUS FOR METALIZING INTERNAL SURFACES OF METAL BODIES SUCH AS TUBES AND PIPES

[75] Inventor: Philip Bernsten, Jr., Chicago, Ill.

[73] Assignee: Inductametals Corporation, Chicago, Ill.

[21] Appl. No.: 491,001

[22] Filed: Oct. 30, 1990

[51] Int. Cl.[5] ..... B05D 7/22; B05D 1/00

[52] U.S. Cl. ..... 427/231; 118/55; 118/408; 118/409; 118/620; 118/DIG. 10

[58] Field of Search ..... 427/231, 234, 430.1, 427/435, 240, 384, 238, 239, 398.1, 377; 118/55, 409, 408, 416, 69, 66, 620, DIG. 10

[56] References Cited

U.S. PATENT DOCUMENTS

| | | | |
|---|---|---|---|
| Re. 24,852 | 8/1960 | Armstrong et al. | 29/429 |
| 2,822,291 | 2/1958 | Hahn | 427/234 |
| 2,845,366 | 7/1958 | Schroeder | 427/234 |
| 3,007,810 | 11/1961 | Hobrock | 427/234 |
| 3,063,860 | 11/1962 | Gemmer | 427/182 |
| 3,158,499 | 11/1964 | Jenkin | 427/237 |
| 3,207,618 | 9/1965 | De Hart | 427/182 |
| 3,218,184 | 11/1965 | Lemelson | 427/182 |
| 3,359,943 | 12/1967 | Briggs et al. | 118/306 |
| 3,394,450 | 7/1968 | Gill et al. | 29/430 |
| 3,405,000 | 10/1968 | Jacobson | 427/182 |
| 3,532,531 | 10/1970 | Stallard | 427/182 |
| 3,654,895 | 4/1972 | Bloom et al. | 118/48 |
| 3,814,616 | 6/1974 | Kondo et al. | 427/182 |
| 3,974,306 | 8/1976 | Inamura et al. | 427/183 |
| 3,982,050 | 9/1976 | Kato et al. | 427/181 |
| 4,071,641 | 1/1978 | Susgi | 427/234 |
| 4,076,136 | 2/1978 | Jenkin | 427/234 |
| 4,122,798 | 10/1978 | Gibson | 118/50 |
| 4,169,906 | 10/1979 | Hallstrom et al. | 427/183 |
| 4,174,410 | 11/1979 | Smith | 427/234 |
| 4,197,336 | 4/1980 | Savchenko et al. | 427/234 |
| 4,243,699 | 1/1981 | Gibson | 427/183 |
| 4,302,482 | 11/1981 | Heck | 427/34 |
| 4,490,411 | 12/1984 | Feder | 427/44 |

*Primary Examiner*—Janyce Bell

*Attorney, Agent, or Firm*—Welsh & Katz, Ltd.

[57] ABSTRACT

Method for coating the inside surface of an elongated metal tubular body which includes placing a plurality of elongated pieces of coating metal into the bore of the tubular body in alignment with the axis thereof, to provide a constant amount of coating metal along the length of the bore. The coating metal melts below the melting point of the tubular body. The bore is freed of oxygen by evacuation or by purging with inert gas. The tubular body and the elongated pieces of coating metal within the bore are then rotated at a high rotational speed sufficient to distribute the elongated pieces against the bore surface while maintaining the constant amount of coating metal along the length of the bore. The rotating tubular body is then heated sufficiently to melt the coating metal pieces and insufficiently to melt the tubular body. Melted coating metal is spread about the bore surface by means of the centrifugal force imposed upon the melted coating metal by the continued rotation of the tubular body. In one apparatus configuration, the rotating tubular body is passed through a heating device and into a cooling zone, and the tubular body is then withdrawn from the cooling zone with a uniform layer of solid metal coating upon the bore surface. In another apparatus configuration, the heating device is passed over and alongside of a rotating but stationary tubular body.

117 Claims, 4 Drawing Sheets

METHOD AND APPARATUS FOR METALIZING INTERNAL SURFACES OF METAL BODIES SUCH AS TUBES AND PIPES

FIELD OF THE INVENTION

The present invention relates to the metalizing of the interior of tubular metal bodies, such as pipes and tubes. More particularly, the present invention relates to method and apparatus for metalizing the interior surface of tubular bodies to produce interiorly metalized articles, such as chrome plated pipes, tubes, and segments thereof. In particular, the present invention relates the metalizing of interior surfaces of tubular products with corrosion resistant metals to provide for extended life for the tubular products in their environment of use.

BACKGROUND OF THE INVENTION

There are many fields of manufacture in which the interior of a base body, such as a pipe or tube, or a segment thereof, is metalized over an ordinary metal such as steel with an expensive surface layer treatment or coating that is fused to the base metal in order to provide a finished, or partly finished, part or product that will respond to manufacturing specifications, but which is less expensive than making the entire body of the same material that the specifications require. Thus, parts such as the interior of pipes or tubes used to convey corrosive or abrasive fluids, liquids, slurries and the like, are frequently required to provide thereon an interior, or concaved, metalized surface of chromium, or chrome, or other special metal or metal alloy, that will either resist corrosion and wear or will provide a good bearing surface. In strings of pipe used in deep oil wells, for example, it is desirable that the interior surface of the pipe have resistance to corrosion or wear, so as to extend the time period that a string of pipe functions before corrosion or abrasive failure causes disruption of oil production and consequent increase of costs. Similarly, strings of pipe which are used to transport concrete slurry from a source of supply to the site of use, must have a wear resistant inner surface in order to withstand the abrasion of the inner surface which is caused by the aggregate (sand, gravel, and crushed stone) which is mixed with the cement in the concrete slurry.

It has been long known that ordinary steels, except for leaded steels or resulphurized steels, may be chrome surfaced by plating or the like, to meet the specifications for desired strength of the part and provide the surface character specially required for exposure to a harsh environment in which the part is to be used.

However, chromium, for example, is a relatively expensive material, and chromium's use in various chemical baths by which chrome plating may be effected, is environmentally undesirable, operationally difficult and expensive to control. Also, it is technically difficult to deposit a metalizing layer of any substantial thickness onto the interior surface of tubes or pipes, or segments thereof, that are to serve as the bearing surface of a bearing or journal element.

While metalizing the exterior surface of bars and rods avoids, to substantial extent, the undesirable environmental effects associated with chemical plating of such bodies, the mechanical metalizing techniques previously employed in metalizing such bars and rods have usually used an open flame torch that burns fuel gases, such as acetylene, propane, or the like in the presence of oxygen, to both preheat the body surface to an elevated temperature and to heat the surface application material, which is initially in powder form, to a temperature at which the powder material will become at least partially molten and fuse onto the base material of the body. These prior art metalizing techniques have not been wholly successful for economically metalizing the exterior of tubes, since the heat of a torch will frequently burn through the wall of the tube. It will be understood that such prior art metalizing techniques also generally are not successful in metalizing the interior of elongated tubes and pipes, since access to the interior of such elongated bodies with an open flame torch is very difficult, if at all possible.

The problems with said prior technique for metalizing exterior surfaces are that there is both lack of accurate control of the thickness of the layer of the surface application material to the underlying body, and resultant lack of uniformity of the thickness of the layer that is applied by open torch heat. Furthermore, the minimum thickness of the layer of applied material usually obtained by metalizing with an open flame torch working with powdered metal, is about 0.008 inches, and the maximum thickness of a layer of applied metal is about 0.015 inches, both of which thickness values are frequently much greater than the thickness of the applied material layer which is required to be supplied to meet the performance specifications for the metalized part, and this substantially increases the cost of manufacture.

A further problem is that when using fine particles of metalizing materials to form a fused surface on an underlying body, the torch heat intensity is frequently so great that it vaporizes or burns away a substantial quantity of the finest particles of the metalizing material, thereby resulting in loss of material and economic waste. Still another problem is that, in the event a thick layer of metalizing is required to be deposited, there is insufficient control over the thickness of metal being deposited and, therefore, maintaining of concentricity of the inner surface of a metalized sleeve or journal is difficult, and machining or other expensive finishing operations must be resorted to in order to obtain a high degree of concentricity of the innermost surface of an arcuate part that has been metalized.

Other techniques are also available for metalizing with a vapor, either in an inert atmosphere or under vacuum. Such processes include chemical vapor deposition and physical vapor deposition, as by evaporation, ion plating, and sputtering. The products of these processes are coatings and free-standing shapes such as sheet, foil and tubing of thicknesses ranging from 20 nm to 25 mm. However, these processes do not lend themselves readily to the metalizing of the bore surface of long lengths of pipe or tubing.

An improved method of metalizing the interior of metal bodies is disclosed in U.S. Pat. No. 4,490,411, which discloses an apparatus and method for metalizing the interior of pipes or tubes using powdered metal. The base metal pipe or tube which is to be internally metalized is moved axially while simultaneously being rotated at a relatively high rpm. A first preheat means, preferably comprising an induction heater, heats a portion of the pipe and its interior to a first elevated temperature, and the particles of the metalizing powder are deposited into the interior of the pipe to be heated to the first elevated temperature. The rotation of the pipe distributes the fluidized particles into laminae which under further influence of centrifugal forces, automatically distributes the semi-fluidized particles effectively. The fluidized metalizing material is bonded together and to the body substrate by application of a second induction heat at a higher temperature at which the bonding then occurs between the laminae of the metalizing material and between the metalizing material and the base material of the tube or pipe. Preferably the process is performed in the presence of a non-oxidizing gas such as preheated nitrogen.

Two means are disclosed for delivering the metalizing powder to the interior of the pipe to be metalized. In one embodiment, the metalizing powder is conveyed to the interior of the pipe by means of a cantilevered boom or supply-support tube through which the metalizing powder, entrained in a stream which includes a pressurized non-oxidizing gas, is delivered in the form of a spray or shower from a nozzle in the interior of the pipe at a station located laterally or axially between the two electrical induction heating coil means, namely a first such induction heating means being a preheater and the second induction heating means being the metalizing heater for accomplishing the metal fusion. In the second embodiment, an elongated auger tube and concentric auger are utilized for delivering metalizing powder to the desired point of discharge between the first induction coil and the second induction coil.

Although the method and apparatus embodiments of U.S. Pat. No. 4,490,411 are capable of producing internally metalized pipe of acceptable quality, the disadvantage with utilizing either of the devices disclosed is that both devices must be supported interiorly of the base tubing or pipe in order to convey the metalizing powder within the center region of the pipe. This means that the process is limited to tubing or piping having a relatively large diameter. In addition, because the delivery point for the metalizing powder is within the tubing from a cantilevered boom, the apparatus is very sensitive to vibration, thereby causing the powder to be unevenly distributed throughout the inside surface of the pipe during periods of bad vibration so that thin spots and high spots of the metalizing thickness may exist upon the inside surface of the fused metalized pipe. A further disadvantage is that by the process of this patent, only short lengths of tubing can be metalized because of the problems entailed in suspending the internal boom which is delivering the metalizing powder.

With this then being the state of the art, it is one object of the present invention to provide an improved method for metalizing the interior surface of metal pipes and tubes.

It is another object of the present invention to provide an improved method of creating a novel and improved product, and the improved product itself, wherein the product is a sleeve or segment of a sleeve consisting of a tube or pipe of a base metal with an interior annulus of expensive metal or metal alloy fused to the inside of the original base tube or pipe.

It is a further object of this invention to provide an internally metalized tube or pipe wherein the thickness of the metalizing layer may be made to almost any desired dimension and may be accurately controlled so as to provide an innermost surface of very precise and concentric nature.

Another object of this invention is to provide an improved method and apparatus for metalizing the interior surface of hollow or tubular bodies with a metal in a manner that eliminates burn-up or burn-away loss of the metalizing material.

A further object of this invention is to provide an apparatus and method for metalizing the interior surface of base metal tubular bodies with relatively expensive metalizing alloys or materials, such as chrome powder, in a manner to provide an accurate control of the thickness of the metalizing layer applied, while simultaneously avoiding economic loss of the metalizing metal through undesired vaporization or burning away of the metalizing material.

Still another object of this invention is to provide a new and inexpensive method of forming a very long pipe or tubing having an internal coating of a corrosion resistant metal.

And still a further object of this invention is to use the effects of both tangential drag imparted by the inner surface of the rotating tube or pipe, and centrifugal force, upon metalizing material that has been changed by heat into at least semi-molten form to achieve a metalized surface that is laminated onto the interior of a base tubular body, and that is characterized by one or more of the following advantageous features: surprisingly and unusual uniformity of the inner surface concentricity of the layer deposited despite substantial thickness of the deposited layer; unusual hardness of the deposited metalizing layer; excellent bond between the metalizing layer and the base tubular body or substrate; and improved concentricity of the innermost surface of the metalizing layer as compared with the interior periphery of the base tube onto which the metalizing layer is deposited.

These and other objects of the present invention, as well as the advantages thereof, will become more clear to those skilled in the art from the disclosure which follows.

SUMMARY OF THE INVENTION

By the practice of this invention, the interior of the pipe or tubing is not metal coated by using a metalizing powder as has been the practice for so many years, but instead, this invention uses elongated solid pieces of coating metal which are slid into the bore of the elongated metal tubular body of the pipe or tubing in order to supply the amount of coating metal which is required in order to achieve the proper thickness of the metalized coating on the interior surface of the tubular bore. Where the tubular body has only a small bore diameter, only one or two pieces of elongated coating metal may be used. However, where the pipe diameter is very large or if the required thickness of the coating is very great, then a substantial number of pieces of the elongated coating material may be inserted into the bore of the pipe. Accordingly, as used herein, when used in reference to the elongated solid pieces of coating metal, the term "plurality" is meant to include, and does include, a single piece of coating metal and more than one piece of coating metal.

In general, the elongated pieces of coating metal have a length which is equal to the axial length of the bore of the tubular body. However, in some embodiments, the elongated pieces of coating metal may be shorter. In those instances, provision is made so that two or more elongated pieces placed end-to-end will cover the full axial length of the internal bore in the tubular body, so that uniform coating will be applied to the inside surface of the bore, both circumferentially and longitudinally.

In its method aspects, the present invention comprehends a method for metal coating the inside surface of an elongated metal tubular body which includes the steps of placing a plurality of elongated pieces of coating metal into the bore of the elongated metal tubular body in parallel alignment with the axis of the tubular body and in position within the bore to provide a substantially constant amount of coating metal along the axial length of the bore. The coating metal must, of course, have a melting point which is below the melting point of the tubular body. The bore of the tubular body is rendered substantially free of oxygen by first plugging or capping the open ends of the bore, and by then purging it with an inert gas, such as nitrogen, helium, argon and the like to remove the air. Alternatively, the oxygen may be removed by first plugging or capping the open ends of the bore, and then imposing a vacuum for removal of the air. The tubular body and the elongated pieces of coating metal contained within the bore are rotated at a high rotational speed sufficient to distribute the elongated pieces against the bore surface while maintaining the substantially constant amount of coating metal along the axial length of the bore, no matter at which radial location the elongated pieces may be found at any given moment. The rotating tubular body is then passed into a heating zone maintained under conditions sufficient to melt the coating metal pieces and insufficient to melt the tubular body. Alternatively, the heating zone may be passed over and about the rotating tubular body in order to melt the elongated pieces of coating metal. The melted coating metal is spread about the bore surface by means of the centrifugal force imposed upon the melted coating metal by the continued rotation of the tubular body. The rotating tubular body is then passed from the heating zone into a cooling zone, or the heating zone is removed from the rotating tubular body to allow cooling to occur, and the tubular body is then recovered with a uniform layer of solid metal coating upon the bore surface. The coating layer will be uniformly thick and uniformly concentric.

In its method aspects, the present invention further comprehends a method for metal coating the inside surface of an elongated metal tubular body which includes the steps of placing a plurality of elongated pieces of coating metal into the bore of the tubular body in parallel alignment with the axis of the tubular body and in position within the bore to provide a substantially constant amount of coating metal along the axial length of the bore. The bore of the tubular body is rendered substantially free of oxygen by purging the bore with an inert gas or imposing a vacuum. The tubular body and the elongated pieces of coating metal contained therewithin are then placed upon a plurality of first rollers rotatably aligned along a first axis in end-to-end orientation, and upon a plurality of second rollers rotatably aligned along a second axis in end-to-end orientation and positioned parallely adjacent to the first rollers, with a narrow gap between said first and second pluralities of rotatable rollers. When the tubular body containing the elongated pieces of metal coating material are placed upon the parallel line of first and second rollers, they are rotated at a high rotational speed sufficient to distribute the elongated coating pieces against the bore surface while maintaining the substantially constant amount of coating metal along the axial length of the bore. The rotating tubular member is then passed by means of a pushing element axially continuously upon the first and second rotating rollers, into and through a heating zone maintained under conditions sufficient to melt the coating metal pieces and insufficient to melt the tubular body. The coating metal is melted in the heating zone and spread in a uniform layer upon the bore surface by means of the centrifugal force imposed upon the melted coating metal by the continued rotation of the tubular member as it passes through the heating zone. The rotating tubular body is next passed by means of the pushing element from the heating zone into and through a cooling zone, and the tubular body is then recovered from the cooling zone with a uniform concentric layer of solid metal coating upon the bore surface.

In its apparatus aspects, the present invention comprehends a coating apparatus for melt coating the interior bore of an elongated metal tubular body which includes a first plurality of rollers rotatably aligned along a first rotational axis in end-to-end orientation, and a second plurality of rollers rotatably aligned along a second rotational axis in end-to-end orientation and positioned parallely adjacent to the first plurality of rollers with a narrow gap therebetween. A heating means is centrally located at the first and second rollers for heating an elongated tubular body and a metal coating material contained therein. A roller motive means for rotating the first and second rollers in a common direction is also provided for rotating the elongated metal tubular body while it is supported on the rollers. A pusher element is provided for pushing the rotating tubular body longitudinally upon the first and second rollers as the tubular body rotates thereon. A pusher motive means moves the pusher element to slide the rotating tubular body from the input end of the first and second rollers through the heating zone comprising the heating means in order to cause the coating material to melt and coat molten metal uniformly on the inside wall of the rotating tubular body as it passes through the heater. A doffing means removes the uniformly coated elongated tubular body from the output end of the first and second rollers after the tubular body has been pushed out of the heating zone, and reciprocating means activates to return the pusher element to the input end of the first and second rollers when the coated tubular body has been doffed.

In the foregoing embodiments of the present invention, the elongated tubular body is passed axially along two banks o rotating rollers and through an induction heater as it rotates. In an alternative mode of operation, the tubular body may be rotated on the two banks of rollers in a stationary location, and the induction heater is passed over and alongside the rotating stationary tubular body.

A clearer understanding of the present invention will be obtained from the disclosure which follows when read in light of the accompanying drawings.

DESCRIPTION OF THE PREFERRED EMBODIMENTS

Figure 1:
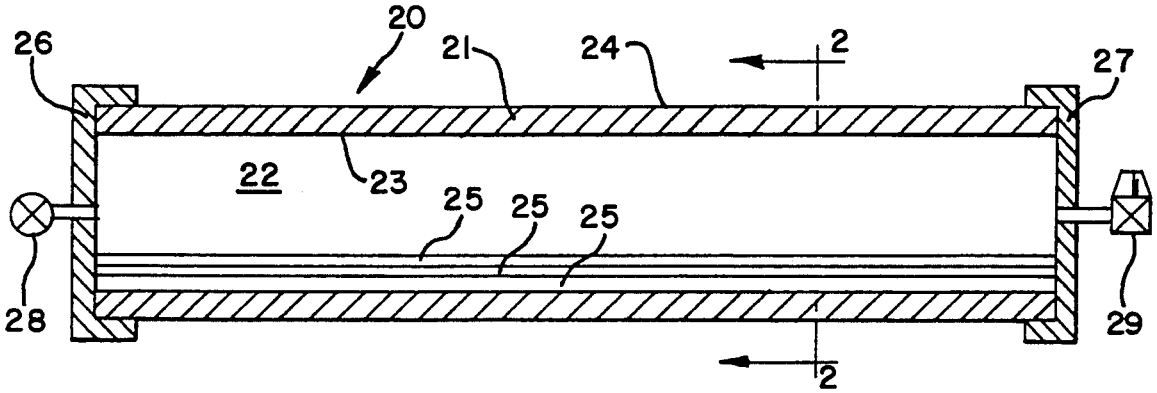
FIG. 1 is a simplified schematic representation of an elongated metal tubular body, such as a pipe or tubing, in accordance with the present invention, shown as a sectional elevational view, containing three elongated pieces of coating metal by way of illustration, and containing end caps over the bore ends.

Referring now to FIG. 1, there is shown a hollow tubular body 20, which is a pipe or tubing length of about 30 to 40 feet in dimension, or even longer. The tubular body has a metal sidewall 21 with a central bore 22. The metal sidewall 21 has an inside tubular surface or bore wall 23 which is desired to be coated with a special metal having corrosion resistance, or abrasion resistance, or wear resistance, or some other characteristic which is not a physical property of the base metal of the tubular body. The sidewall 21 also has a outside cylindrical surface 24.

In order to assure that the special metal coating material which must be metalized on the base metal of the tubular body bore will fuse and adhere properly to the bore surface, the tubular body bore must first be cleaned to rid the bore surface of surface contaminants, such as dirt, grease and metal oxides. Sand blasting, bead blasting or pickling may be used for this purpose. As soon as this is accomplished, the metal coating material is placed in the cleaned bore and is enclosed therein. Air which is also enclosed in the bore is then purged out with an inert gas such as nitrogen, helium, argon and neon.

FIG. 1 shows that the bore of the tubular body 20 contains elongated pieces of coating metal, which in this embodiment are shown as wire inserts or metal rods 25. Three of such elongated pieces of coating metal 25 are seen in FIG. 1 for purposes of simplicity in the illustration. It is to be noted that all wire inserts are of the same length as the length of the bore 22 in the tubular body 20. This is to provide that a uniform thickness of coating metal will be fused to the bore surface both longitudinally and circumferentially as the tubular body is rotated. The number of wire inserts which are utilized will depend upon the diameter of the wire inserts and the thickness of the coating metal that is necessary to be placed upon the bore surface. In general, the diameter of the wire inserts will be established so that the 30 or 40 feet of the elongated piece of coating metal can be placed inside of the tubular bore with no bending or kinking which would thus cause the inserted length of the wire to be insufficient to extend the entire length of the tubular bore. Those skilled in the art can readily perceive how to calculate how many such wire inserts must be slid into the bore of the tubular body in order to achieve the necessary coating thickness by simple mathematics.

When the elongated pieces of coating metal, the wire inserts 25, have been placed inside of the bore of the tubular body 20, a left closure member or end cap 26 is placed upon one end of the tubular body and a right closure member or end cap 27 is placed on the other end of the tubular body. This then confines the wire inserts of coating metal within an enclosed space. The left end cap has a valve 28 for allowing an inert gas to be introduced into the space of the internal bore 22. This inert gas is used to purge out substantially all air which remains in the bore 22 by means of an expansion valve or relief valve 29 which is on the right end cap. The expansion valve has a setting which allows a slight overpressure to exist within the bore 22 so that a positive pressure is retained therein to keep air out. When the air has been properly purged out of the tubular bore 22, valve 28 is closed and the purge of nitrogen is discontinued with the supply hose being disconnected. At this point, the expansion valve 29 is still operative for relief of increased pressure within the bore 22 when the tubular body is later placed in a zone of elevated temperature.

Figure 20:
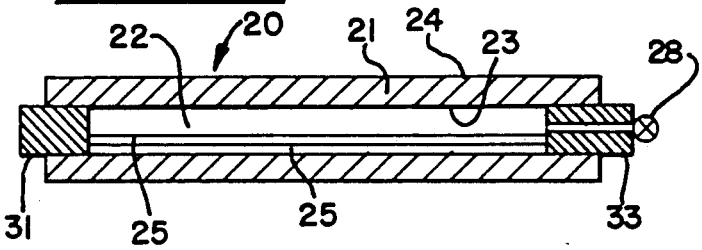
FIG. 20 is a simplified schematic representational cross-sectional view in side elevation of an elongated tubular body according to FIG. 1 wherein the tubular body contains two elongated wires and the bore open ends are sealed with end plugs instead of end caps.

Alternatively, the air may be removed from the tubular bore 22 by means of a vacuum. In such an operation a vacuum line is connected to valve 28 on end cap 26, and a vacuum is then imposed on the air within the tubular bore. The level of vacuum which is imposed within bore 22 must not, of course, exceed the compressive strength of the pipe sidewall 21. When the bore has been evacuated to the desired degree, it may then be filled with an inert gas to slightly above atmospheric pressure in order that a positive pressure remains in the bore and oxygen (air) cannot leak back into the bore 22. Alternatively, the tubular body 20 may be kept under vacuum, in which case the tubular body will function as a vacuum furnace when it is heated and the elongated wire inserts are melted within the bore and coated on the bore surface. Generally, end cap 27 will not have a pressure relief valve 29, although it may have a block valve similar to valve 28, when the tubular body 20 is operated like a vacuum furnace. FIG. 20 shows a tubular body, similar to that of FIG. 1, which has been evacuated and which does not have an expansion valve, since it is intended to operate as a vacuum furnace when the coating material is melted and then fused to the bore surface. In this embodiment, end caps 26 and 27 are not used, but end plugs 31 and 33 are used instead.

Figure 2:
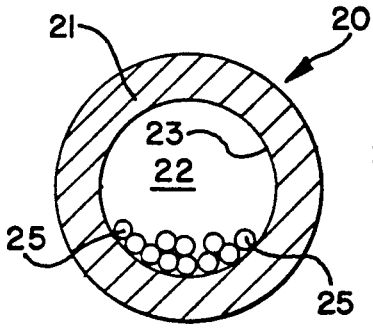
FIG. 2 is a sectional view of FIG. 1 taken along the section line 2—2.
Figure 3:
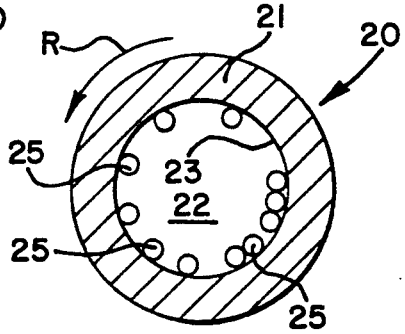
FIG. 3 is another sectional view of FIG. 2 wherein the tubular body has begun to rotate, thereby shifting the position of the elongated pieces of coating metal.
Figure 4:
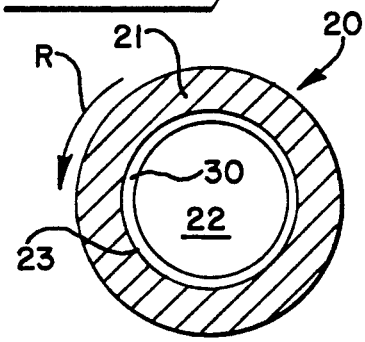
FIG. 4 is another sectional view showing the views of FIGS. 2 and 3 wherein the rotation continues and the temperature has reached the point where the elongated pieces of coating metal have become melted.

Referring now to FIGS. 2, 3 and 4, cross-sections of FIG. 1 are shown with the positions of the wire inserts 25 being shown in FIGS. 2 and 3. FIG. 2 depicts the position of the plurality of wire inserts 25 when the tubular body 20 is first loaded with the wire inserts and after purging. The tubular body 20 is then placed upon the parallel banks of rotating rollers, as has been previously described, and as will be described in greater detail hereinafter. As seen in FIG. 3, when the tubular body 20 first begins to rotate on the two banks of rollers in the direction of the arrow R, the sudden motion will cause the wire inserts 25 to shift into different positions against the surface 23 of the bore. When the tubular body is then passed through a heating means, the different wire inserts will melt in position causing the liquid coating metal to spread out in a pool on the surface 23 of the bore. Since the tubular body 20 is rotating at a rapid speed, for example, 800 to 2,000 rpm, the liquid metal of the wire inserts will be caused to spread evenly about the inner surface 23. This spreading is caused by two forces known in classical fluid flow systems. The inner bore surface 23 of the rotating tubular body develops a drag force on the liquid metal pool and centrifugal force combines therewith to force the metal pool to adopt a concentricity that is most precisely centered about the axis of rotation of the tubular body being internally coated. When the rotating tubular body 20 is removed from the zone of high temperature, the melted wire inserts will cool and the coating metal will become fused to the inner surface 23 to provide an annulus of fused inner surface coating 30 on the bore surface, as shown in FIG. 4.

Figure 5:
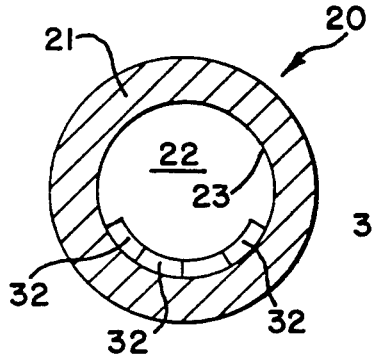
FIG. 5 shows a second embodiment of elongated pieces of coating metal in a Figure similar to that of FIG. 2.

FIG. 5 illustrates a second embodiment of elongated pieces of coating metal. In this embodiment, ribbon inserts of coating metal 32 are positioned within the bore 22 when the tubular body has been prepared for coating with the coating metal. The elongated pieces are metallic ribbons having six rectilinear faces. Ribbons 32 also extend the full axial length of the tubular body, which typically is 30 or 40 feet. Just as in the case of the metallic wires or rods in FIGS. 1 through 3, the number of ribbons required to produce the necessary bore coating can be determined mathematically. Additionally, the ribbons are sized in cross-section so that they will not bend and kink when being placed into the bore of the tubular body. Preferably the cross-section is arcuate as shown in FIG. 5 so that the ribbon bottom surface is flush against the bore surface. As the tubular body is rotated in the process, the ribbon inserts 32 shift position on the wall of the bore 22 as has been previously illustrated in FIG. 3. When the tubular body 20 is moved into the zone of increased temperature, the ribbon inserts will melt and fuse to the inner bore surface, similar to what has been shown in FIG. 4.

Figure 6:
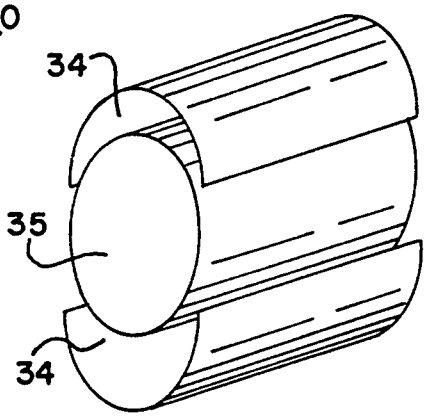
FIG. 6 is a perspective view of a third embodiment of elongated pieces of coating metal.

FIG. 6 shows a cylindrical sleeve as a third embodiment of elongated pieces of coating metal. The cylindrical sleeve is made up of two half cylinder liners 34 of the coating metal. In order to position the two half cylinder liners properly in order to form a liner cylinder which can be inserted into the bore of the tubular body 20, a cylindrical former 35 is used. The former is placed upon a lower half cylinder liner 34 and then a second half cylinder liner 34 is placed upon the former 35. The assembly of three elements is then inserted into the bore of the tubular body 20. When the two liner halves are firmly within the bore, the cylindrical former is removed. The liner halves are then pushed all the way into the bore and another pair of liner halves 34 is then mounted on the former 35 and pushed into the bore after the first pair. The edges of the liner halves are crimped to assure that various liner halves will not slide over and lap each other. If this could otherwise occur, some portions of the bore surface would not be covered by the coating metal so that an incomplete lining of the surface could occur. In general, when a 40 foot piece of tubular body 20 is being internally coated, four 10 foot sections of cylinder will be slid into the bore, each of the four sections comprising an upper half cylinder liner and a lower half cylinder liner. The liner halves may be fabricated of wire mesh, including a woven wire mesh, in order to reduce the thickness of the final coating on the bore surface.

Figure 7:
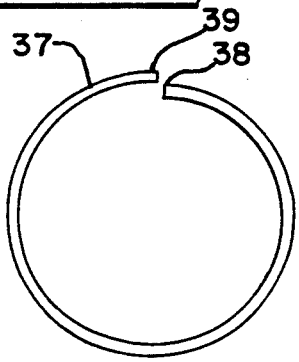
FIG. 7 is a fourth embodiment of an elongated piece of coating metal.

FIG. 7 illustrates yet a fourth embodiment of the elongated pieces of coating metal. In this embodiment, a hoop cylinder 37 having an open seam with two ends 38 and 39 is formed with an offset gap. This produces a spread cylindrical liner of coating metal. As with the half cylinders, the spread cylindrical liner of coating metal is also inserted into the bore of the tubular body 20 in sections of 10 feet in axial length. In this instance, however, the spread cylindrical liner sections have a diameter which is greater than the bore. The spread cylindrical liners are inserted into the bore by compressing the open hoop of the liner 37 slightly so that the edges 38 and 39 ar brought together. At this moment, the diameter of the spread cylindrical liner is equal to or less than the inside diameter of the bore and each section can be easily slid into the bore when it has been compressed in this manner. The spread cylindrical liners may be made of wire mesh in order to reduce thickness of the final coating on the bore surface.

The method and apparatus aspects of the present invention will now be made clear by the discussion which follows in reference to FIGS. 8–12.

Figures 8, 9, 11, 12:
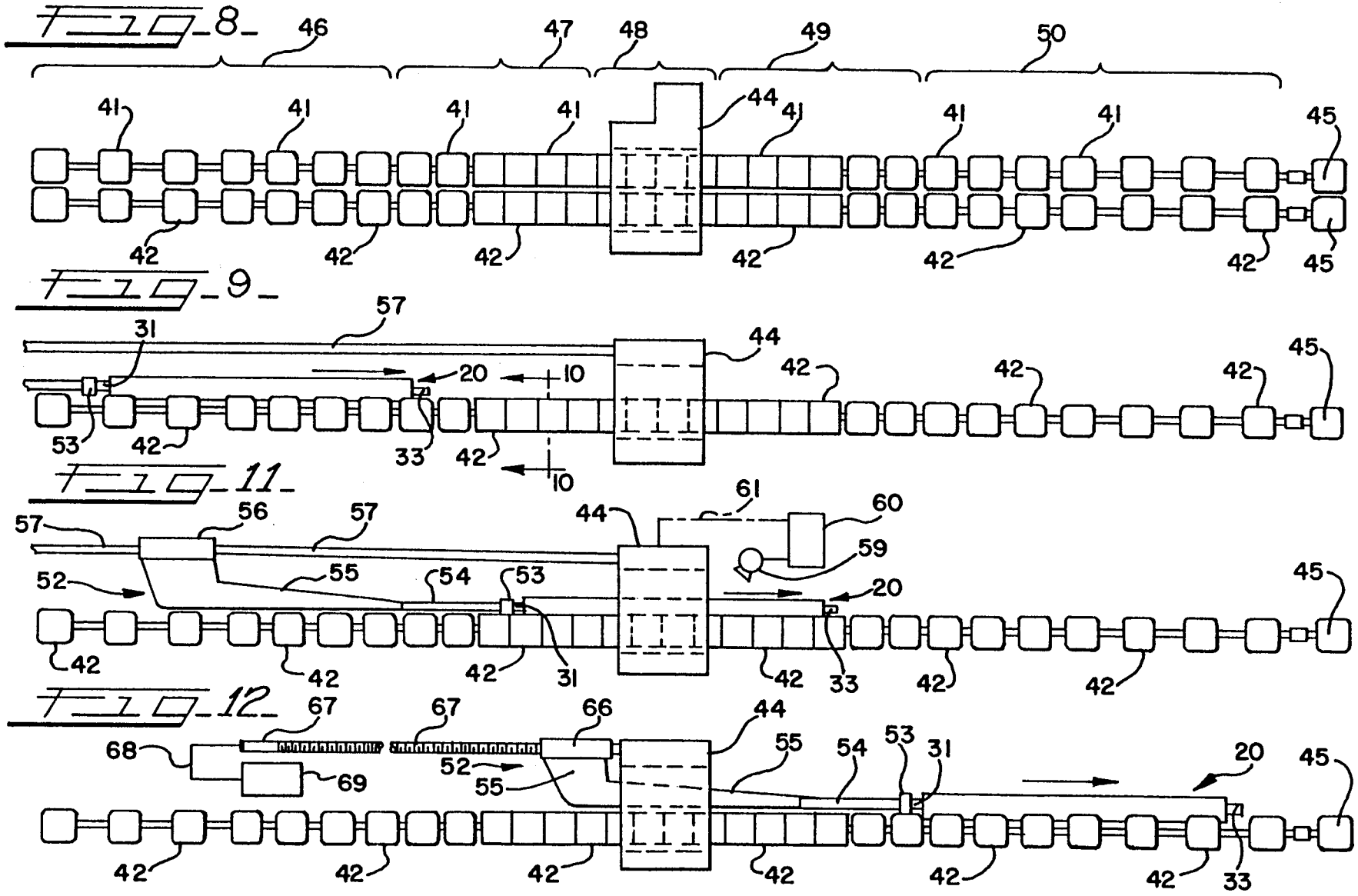
FIG. 8 is a simplified schematic representational plan view of the machine bed and heater for one embodiment of an apparatus to be used in practicing the method of the present invention.
FIG. 9 is a simplified schematic representation in elevational view of the apparatus of FIG. 8 with an elongated tubular body positioned at the input end of the apparatus.
FIG. 11 is a simplified schematic representation in elevational view of the apparatus of FIGS. 8 and 9 with the elongated tubular body passing through the heater.
FIG. 12 is a simplified schematic representation in elevational view of the apparatus of FIGS. 8, 9 and 11 with the elongated tubular body reaching the output end of the apparatus.

FIG. 8 is a schematic plan view showing the machine bed for the apparatus for metal coating the interior of an elongated metal tubular body. The machine bed contains a plurality of first rollers 41 rotatably aligned along a first rotational axis in end-to-end orientation, and a plurality of second rollers 42 rotatably aligned along a second rotational axis in end-to-end orientation and positioned parallely adjacent to the first rollers 41, with a narrow air gap between. The two banks of rollers 41 and 42 are driven by variable speed motors 45, and they are surrounded by a centrally located heating means 44 which is preferably an induction heater. The term "centrally located" does not mean that the heater is at the direct midpoint of the bed length, but merely that the heater is intermediate of the input and output ends of the banks of rollers in the general vicinity of the midpoint of the length, although it can be at the exact midpoint.

When the elongated tubular body has been prepared by bore surface cleaning, by insertion of the elongated pieces of metal coating material, by sealing the ends of the tubular body with caps or plugs, and by evacuation or purging with inert gas, the tubular body is placed into inventory with other specimens of the prepared tubular body. When a sufficient number of specimens have been prepared for processing, an operational run is begun and internally metalized tubular bodies are produced in an extended run which will generally last for days and even weeks. All during the run, additional specimens are continually prepared and placed in inventory for processing. In general, a single specimen will remain in inventory for from two to twenty-four hours.

As seen in FIG. 9, which is a schematic elevational view, a tubular body 20 of the type shown in FIG. 20 is placed upon the banks of rollers at the input section 46 of the machine. (Sections 46–50 of the machine are identified in FIG. 8.) At this point the tubular body 20 begins to rotate upon the two banks of rollers 41 and 42, and a rotatable pusher pad 53 of a pushing member 52 is placed against the rear end of the elongated tubular body 20, thereby contacting end plug 31. The rotatable pusher pad is mounted on a rotation shaft 54. The rotation shaft is, in turn, mounted on a support arm 55 which is suspended from a trolley or slide carriage 56 mounted on a trolley or slide rail 57. The trolley or slide carriage 56 is moved on rail 57 by conventional means such as pneumatic or hydraulic cylinders or motor driven belts or chains. Rail 57 is supported at one end upon the heater 44 and at the other end upon a column or frame, not shown. (The complete pushing member 52 first appears in FIG. 11.)

The pusher arm 52 then indexes forward (toward the right) to push the rotating tubular body 20 at a speed of about 8 to 10 ft./min. toward the induction heater 44, thereby causing eddy currents to arise within the tubular body 20 and the confined elongated pieces of coating material, such as the wires 25 which are contained within the bore. The eddy currents cause the temperature of the tubular body and the elongated pieces of coating metal to rise as the tubular body 20 approaches the induction heater 44. Thus, the inlet approach to the induction heater 44 functions as a preheating section 47, and the tubular body and its contents are increasingly warmed up as they approach closer to the induction heater 44. The preheating section 47 is generally at a range of from about 1950° F. to about 2050° F. Accordingly, the nitrogen pressure within the bore of the tubular body 20 increases, thereby causing the relief valve 29 on one end cap to open and vent off excess internal pressure.

When the tubular body 20 passes into and through the induction heater 44, see FIG. 11, it is at its maximum excitation of eddy currents and this then comprises the direct heating section 48, wherein the coating metal melts and forms a liquid pool on the bore surface of the tubular body. In order to assure that only the elongated pieces of coating metal melt and that the tubular body 20 does not melt or even overheat and approach a condition of plasticity, optical pyrometer 59 is coupled to temperature controller 60 to control the power supplied to induction heater 44 by means of signal transmission line 61. Generally, the induction heater has an operating range of from about 1700° F. to about 2150° F. As the elongated tubular body and its contents pass fully through the induction heater (direct heat section 48), the eddy currents begin to diminish and on the outlet side of the induction heater 44 there is then a post-heat section 49. In this section 49, the eddy currents continually diminish as the elongated tubular body 20 withdraws from heater 44, so that the tubular body and its contents begin to cool. The liquid metal pool on the bore surface of the rotating tubular body now gels, sets-up, and fuses into a solid layer of perfectly concentric coating metal.

The rotating tubular body is continually pushed further by the pushing member 52 until it enters the ambient output section 50, FIG. 12, at which point the temperature has diminished to the level where the fused coating layer 30 and the rotating tubular body 20 may now be removed from the apparatus and sent to product finishing operations, such as end cap or end plug removal and trimming of tubular body ends. The internally coated elongated tubular body 20 is now doffed or off-loaded from the machine and the pushing member 52 is quickly reciprocated back to the inlet end of the machine at the ambient inlet section 46 to prepare to pass another elongated tubular body through the induction heating element. The off-loading of the tubular body may be done by having the pushing member 52 push the tubular body 20 axially until it is pushed completely off of the rollers and onto a take-away conveyor. Alternatively, another device, not shown, may be used to discharge the tubular body over the side of the rollers and onto a take-away conveyor. "Over the side" is the preferred method.

FIG. 12 shows an alternate means for moving the pushing member 52 forward and then rapidly reciprocating it backward. In this embodiment the motive means is a helical drive unit. It includes a helical drive carriage 66 having an internal helical thread, not shown, from which the pushing member 52 is suspended. Helical drive screw 67 moves the helical drive carriage back and forth. Screw 67 is in turn driven by a conventional coupling means 68, such as a belt or chain or a positive drive shaft which is coupled to a variable speed reversible drive motor 69.

Referring again to FIG. 8, it should be noticed that the coating apparatus has a variation of spacing between the end-to-end rollers depending upon the location of the rollers within the elongated machine bed. The rollers 41 and 42 which are located adjacent to and within the heater 44 are present with a greater concentration of end-to-end rollers and a smaller dimension between end-to-end rollers. However, as the distance from the heating unit 44 to the input and output ends of the rollers increases, the concentration of rollers decreases and the dimension between end-to-end rollers increases.

At the inlet and outlet end of the machine bed, the elongated tubular body 20 is at ambient temperature and a wide spacing between rollers is acceptable, since the elongated tubular body has its normal structural rigidity. On the other hand, as the elongated tubular body approaches the induction heater 44, eddy currents begin to arise within the elongated tubular body and the elongated pieces of coating metal therewithin. Accordingly, the rotating elongated tubular body 20 and its contents begin to heat up rapidly as the tubular body approaches the induction heater 44. Thus, in order to assure that the tubular body retains its proper tubular structure as it becomes hot, and possibly approaches a condition of plasticity, the rollers are spaced close together to provide necessary support adjacent to and within the heater. In general, the rollers are spaced one-quarter of an inch to three-eighths of an inch apart within the induction heater 44 and at its entry and its exit regions. As the distance from the entry and exit ends of the induction heater increases, the spacing becomes increased since the tubular body is at cooler temperatures and rigid, notwithstanding that it may have approached a plastic condition within and adjacent to the induction heater 44. Thus, moving outward from the concentrated rollers at the heater with a spacing between rollers of three-eighths inch, we typically find several rollers with a one inch spacing, followed by several with a two inch spacing, followed by several with a three inch spacing, etc., until the several outermost rollers at each end of the apparatus have a six inch spacing. Thus, the rollers are positioned in such a way that as the tubular body cools, the rollers spread out longitudinally while still supporting the tubular body, rotating it, and keeping the internal coating 30 concentric.

It is because of this longitudinal spacing between rollers that the tubular body of FIG. 20 must be used with this apparatus and the tubular body of FIG. 1 must not be used. The FIG. 20 tubular body has end plugs 31 and 33 which have a diameter smaller than the tubular body diameter. Thus, the end plugs will not touch the rollers at any time. In contrast, the end caps have a diameter which is greater than the tubular body diameter. Thus, the end caps will fall into the axial gaps between the rollers and damage the rollers and the moving tubular body.

Figure 10:
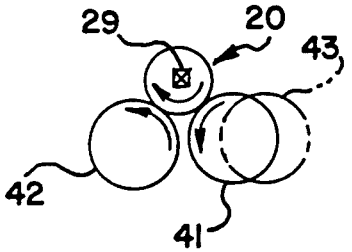
FIG. 10 is a simplified schematic representation of how an elongated metal tubular body in accordance with the present invention operates within the machine bed of FIG. 9 as seen along viewing line 10—10.

FIG. 10 is a simplified schematic representation of how an elongated metal tubular body in accordance with the present invention operates within the machine bed of FIG. 8 as seen along viewing line 10—10 of FIG. 9. It can be seen that the elongated tubular body 20 rests upon the two parallel banks of rollers 41 and 42. The rollers are rotated in unison and synchronization counterclockwise in order to turn and rotate the elongated tubular body 20 in a clockwise direction. Alternatively, the rollers may be turned clockwise in order to turn the tubular body counterclockwise. The rollers must be rotated in synchronization and in unison. Additionally, all rollers must have the same diameter. If the tubular body has a larger diameter than what is illustrated in FIG. 9, then one of the banks of rollers 41 may be moved away from the other bank of rollers 42 to a position which is illustrated by the phantom circular line 43. Thus the same machine bed may be used for different sizes of tubular bodies 20 during different production runs.

It will be recognized by those skilled in the art that in order for the internally coated tubular body to have a fused inner surface coating which is of uniform thickness and perfect concentricity, the tubular body must be kept perfectly horizontal while it is rotated. In addition, vibration should be minimized. Thus, it is important that the two banks of rollers 41 and 42 be kept perfectly level and in perfect alignment with each other.

The foregoing method and apparatus description relates to a first embodiment of the invention, wherein the coating operation is conducted by moving the tubular body, containing elongated pieces of coating metal, in relation to the heating means. The invention is also capable of being operated by leaving the tubular body in a stationary position and moving the heating means in relation to the tubular body. This second embodiment will now be described with reference to FIGS. 13–18.

Figure 13:
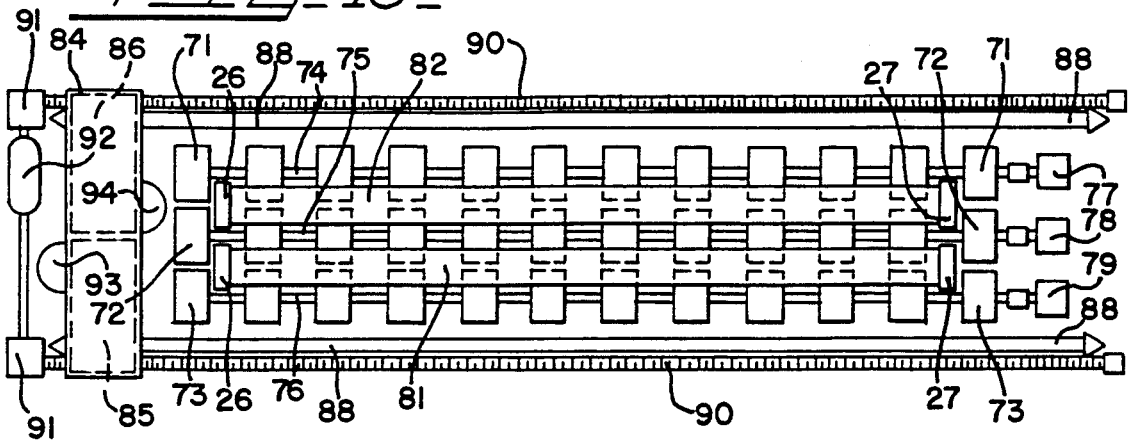
FIG. 13 is a simplified schematic representational plan view of an apparatus to be used in practicing a second embodiment of the method of the present invention.

Referring now to FIG. 13, there is shown a simplified schematic plan view of a coating apparatus containing a bank of first rollers 71, a bank of second rollers 72, and a bank of third rollers 73. The first rollers 71 are mounted upon a first rotatable shaft 74, the second rollers 72 are mounted upon a second rotatable shaft 75, and the third rollers 73 are mounted upon a third rotatable shaft 76. A first variable speed electric motor 77 is directly coupled to the first shaft 74 in order to drive the bank of first rollers 71. Similarly, a second variable speed electric motor 78 is directly coupled to the second shaft 75, and a third variable speed electric motor 79 is directly coupled to the third shaft 76. A first tubular body 81, such as a 30 or 40 foot length of pipe, is mounted upon the apparatus in the crease or groove between the bank of third rollers 73 and the bank of second rollers 72, and a second tubular body 82 which is also a 30 or 40 foot length of pipe is supported in the crease or groove between the bank of second rollers 72 and the bank of first rollers 71. A heating means 84 which houses a first induction heater 85 and a second induction heater 86 is positioned on the left end of the three banks of rollers. Alternatively, heating means 84 may be a single induction heater containing two independently operated and controlled induction coils.

Figure 18:
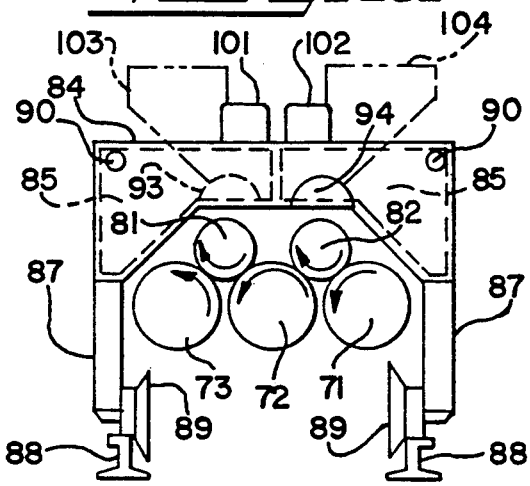
FIG. 18 is a simplified schematic representational end view of the apparatus of FIGS. 13-17 showing the configuration and structure of the heating unit which advances over the machine bed of rollers and the two tubular bodies, as seen along the viewing line 10—10 of FIG. 9.

As seen in FIGS. 13 and 18, the heater 84 is mounted on a trolley 87 which rides on rails 88 by means of a plurality of flanged wheels 89, only two of which are seen in FIG. 18. The trolley 87 is moved by means of a helical screw drive consisting of two drive screws 90 passing through the heating means 84. Each screw 90 mates with an internally threaded collar, not shown, contained inside of heating means 84. The helical screw drive further includes two drive transmissions 91 which are coupled to the drive screws 90 and to a variable speed reversible drive motor 92. Alternatively, the heater 84 may be supported from above, in which case the trolley 87 would be attached at the heater roof, the wheels would be above the trolley, and the rails would be suspended from an overhead supporting structure.

Also as part of the heating means 84 there is a first heat sensor 93, such as an optical pyrometer but preferably an infrared digital pyrometer, for sending a temperature signal via a first signal transmission means 101, shown as a phantom line, to a first temperature control means 101 supported on the top of the heating means 84. (Refer now to FIGS. 17 and 18) This heat sensor 93 is positioned to pass above the first tubular body 81. Similarly, a second heat sensor 94, which preferably is also an infrared digital pyrometer, is mounted on the housing of the heating means 84 in order to sense the temperature of the second tubular body 82 when the heating means 84 passes over it, and to then send a temperature indicating signal to a second temperature controller 102 via signal transmission means 104, also shown as a phantom line.

It is to be noted that tubular bodies according to FIG. 1 are shown in FIGS. 13–17. This is because the end caps 26 and 27 are positioned in the axial spaces between adjacent rollers, so that no damage can occur to the rotating, but stationary, tubular bodies, and no damage can occur to the rotating rollers. However, end plugs can be used instead of end caps, if desired.

In order to understand the second method embodiment of the present invention, now refer to FIGS. 13–17 sequentially.

Figure 14:
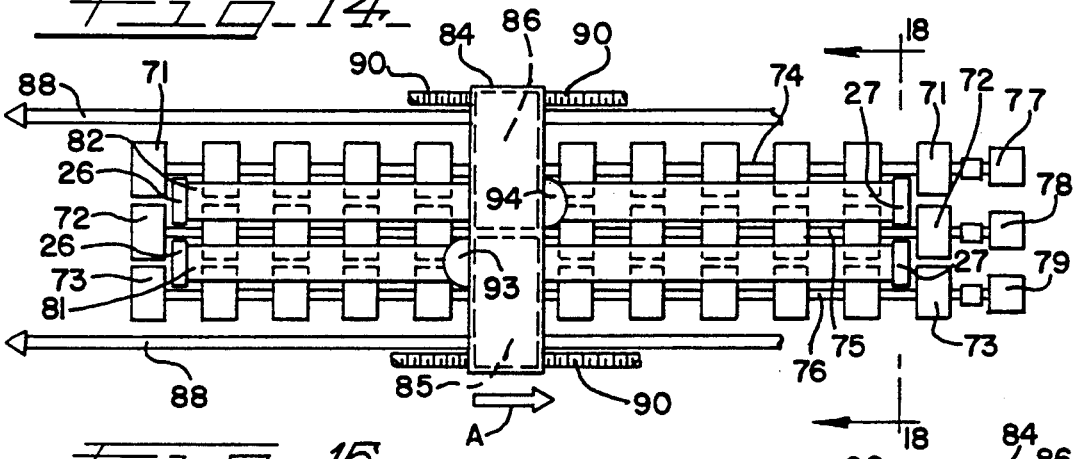
FIG. 14 is a simplified schematic representational plan view of the system of FIG. 13, showing the heating unit advancing from the left end of the machine bed toward the right end of the machine bed over the two tubular bodies which are positioned on the rollers of the machine bed.
Figure 15:
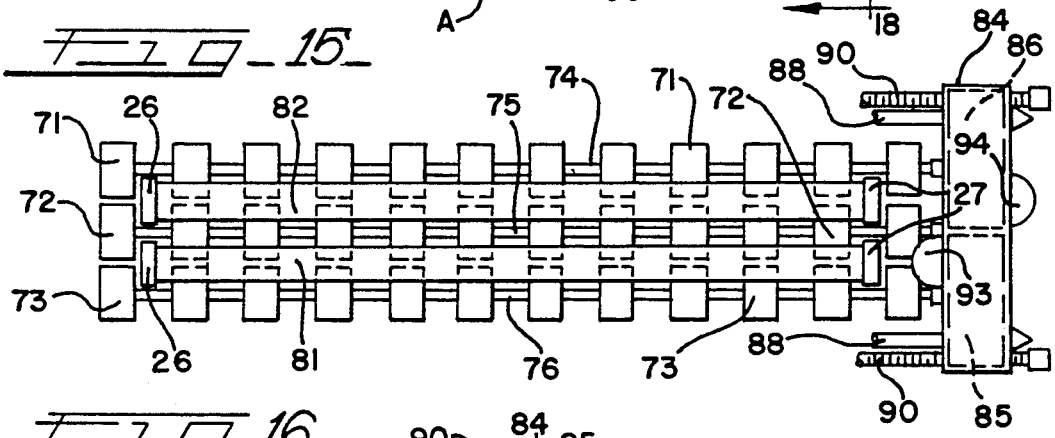
FIG. 15 is a simplified schematic representational plan view of the system of FIG. 13 with the heating unit having reached the right end of the machine bed of the apparatus.

At the beginning of the method sequence, the heating means 84 is located at the left end of the three banks of rollers 71, 72, 73 (FIG. 13). With the first and second tubular bodies 81, 82 rotating in place within the creases between the banks of rollers, the motor 92 is activated to move the heating means 84 along the helical screws 90 toward the right, as shown by arrow A (FIG. 14). As the heating means begins moving toward the right, the first induction heater 85 is activated and causes eddy currents to pass within the first tubular body 81 as the induction heater passes over, thereby heating the first tubular body and the elongated metal coating material which is within to thus cause the metal coating material to melt as the first tubular body is being rotated and heated. This melting creates a moving pool of metal which moves along the length of the tubular body in conjunction with the moving first induction heater 85, always leaving a lengthening uniform solid coating layer behind as it moves along the bore surface with the moving heating means 84. When the heating means reaches the right end of the three banks of rollers, the first induction heater 85 is shut off. The heating means passes beyond the end of the three banks of rollers and comes to a complete stop (FIG. 15). During the time that the heating means 84 has been passing over the first tubular body, the temperature sensor 93 has sensed the temperature of the tubular body as it passed over it, and continually sent control signals to the temperature controller 101 which operated to maintain the temperature of the first tubular body at the desired level.

Figure 16:
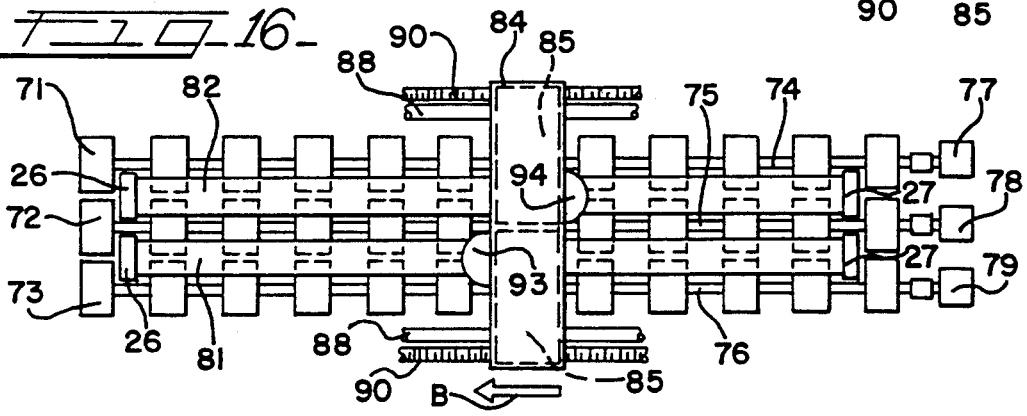
FIG. 16 is a simplified schematic representational plan view of the apparatus of FIG. 13 with the heating unit now advancing from the right end of the machine bed toward the left end of the apparatus.
Figure 17:
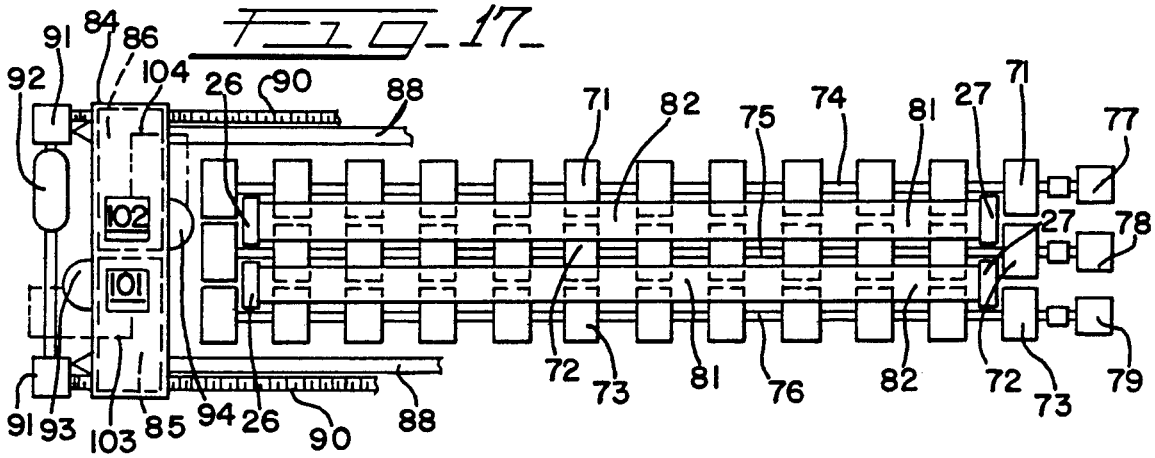
FIG. 17 is a simplified schematic representational plan view of the apparatus of FIG. 13 where the heating unit has reached the left end of the machine bed.

At this point, the motor 92 is activated and the helical screw drive reverses direction. The heating means 84 now moves towards the left in a return pass, as shown by the arrow B (FIG. 16). As this occurs, the second induction heater 86 is turned on and the first induction heater 85 has been turned of so that now the first elongated tubular body 81 is in a cooling phase and the second elongated tubular body 82 is in a heating phase because the activated second induction heater 8 is heating the second tubular body 82 as it passes over it. As the heating means 84 passes over the tubular body 82, the second pyrometer 94 is passing temperature control signals to the temperature controller 102 in order to maintain the temperature level of the second tubular body at the required temperature which melts the elongated pieces of the coating material within the bore of the second tubular body. This causes a moving pool of metal to move along the bore surface followed by a lengthening uniform solid coating layer as has been previously described. When the heating means 84 passes beyond the left end of the three banks of rollers, it has reached the end of travel. The heating means 84 stops and the second induction heater 86 shuts off. This now allows the first tubular body 81 to be off-loaded from the apparatus and passed on for finish processing. A new tubular body is then laid in the crease between the first and second banks of rollers and is rotated. The helical drive system starts in the reverse direction to start the motion of the heating means back toward the right once again, thereby allowing the new tubular body to be rotated and heated for the melting and coating of the coating metal while the second tubular body 82 is being cooled.

In this manner, the helical drive system reciprocates the heating means 84 back and forth to alternately heat one of the tubular bodies on the banks of rollers while the other is being cooled, and then reverse its direction to heat a replacement tubular body while the previously heated tubular body is being cooled. At the end of each pass an internally coated tubular body is off-loaded and replaced by another tubular body. This operation is continuous until the supply of tubular bodies is depleted.

Figure 19:
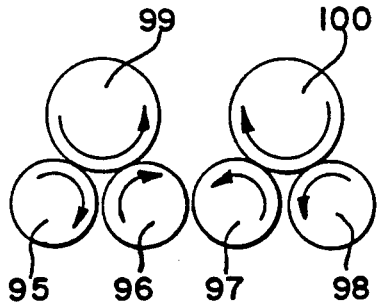
FIG. 19 is a simplified schematic representational end view of the rollers and two tubular bodies when the diameter of the tubular bodies exceeds the diameter of the rollers.

It will be seen in FIGS. 13–18 that the method and apparatus for the second embodiment of the present invention operates to process two elongated tubular bodies, such as pipes or tubes, at the same time. This is done with three banks of rotating rollers when the diameter of the tubular bodies is small in relation to the diameter of the rollers. However, when the tubular bodies have a diameter which is equal to or larger than the diameter of the rollers, three banks of rollers will not operate since the large diameter tubular bodies will touch each other and will not seat properly within the groove between the parallel banks of rollers. Accordingly, in such an operation, four banks of rollers must be used, as shown in FIG. 19. It can be seen in FIG. 19 that the tubular bodies 99 and 100 have a diameter which is substantially greater than the diameter of the rollers 95, 96, 97, and 98. Accordingly, by having the large diameter tubular bodies rotated upon a four bank roller system, as shown, with one tubular body on each pair of banks of rollers, it is assured that the tubular bodies being processed together will not touch each other or otherwise interfere with the operation.

In general, pipe and tubing which may be processed by the present invention will have diameters ranging up to about 15.0 inches, and even higher. However, the diameter cannot be less than about 0.5 inch as a minimum. This is generally true for all embodiments of the present invention.

By the practice of the present invention, an elongated tubular body may be coated internally with the metal coating material to a thickness of from about 0.010 inch to about 0.040 inch, or even thicker. Any known coating metal may be applied to any metal substrate with the proviso that the coating metal must have a melting point which is substantially below the melting point of the elongated tubular body. Typical substrate metals for the elongated tubular body are carbon steel, aluminum, copper, and the like. Examples of coating metals for corrosion resistance and abrasion resistance include Colmonoy, Chrome, Inconel, Monel, stainless steel, and Cermet. Examples of coating materials which may be applied to the inside surface of the bore of the tubular body in order to impart surface hardness include molybdenum, nickel, and Cermet. Other coating materials typically include aluminum, copper, silver, platinum and gold.

It is preferred that the coating material be composed of a metal with a brazing flux. The brazing flux provides a means for scavenging trace amounts of oxygen and surface impurities from the inside surface of the bore of the elongated tubular body when the coating metal is being melted and fused to the bore surface. The flux additionally acts to allow the melted coating material to flow uniformly throughout the bore surface. One typical coating material which has been used is composed of silicon, boron, nickel, and chrome. Silicon and boron function as the flux. By adjusting the ratio between the nickel and the chrome in the coating material, one can impart the bore surface with the characteristic of corrosion resistance or of surface hardness. For example, by raising the chrome content of the coating material the surface layer of the finished product will have an increased corrosion resistance and a reduced hardness. On the other hand by lowering the chrome content of the coating material one can increase the surface hardness while reducing the corrosion resistance. A coating material such as this is available in elongated structural form for use in the practice of the present invention from METCO, a division of Perkin-Elmer Corporation, located in Westbury, N.Y. 11590. The use of such a coating material will, of course, cause the metal coated bore surface of the tubular body to be coated with slag. The slag is removed by sand blasting or pickling in order to produce a finished product of the internally coated elongated tubular body.

Figure 21:
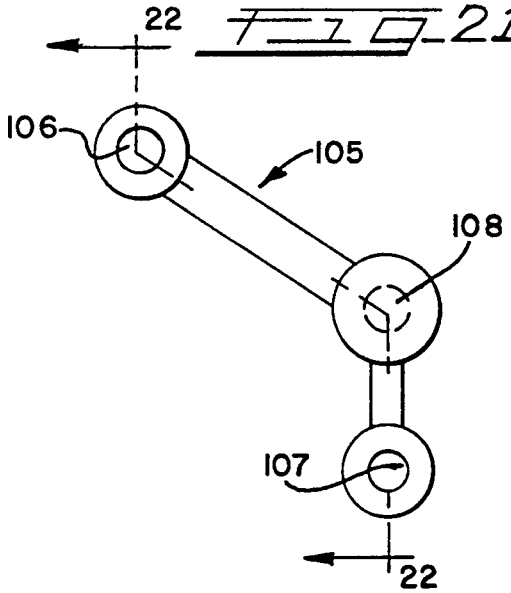
FIG. 21 is a simplified schematic front elevational view of an irregularly shaped linking member containing three bores for coating according to the method of the present invention.
Figure 22:
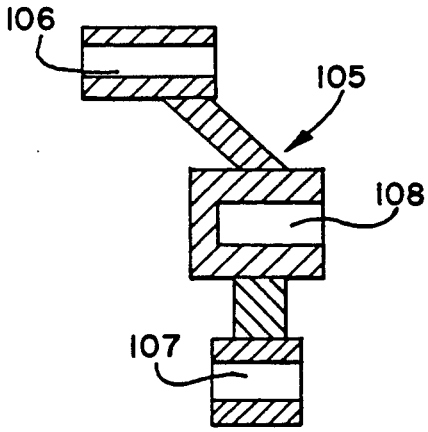
FIG. 22 is a simplified schematic right side elevational view, in cross-section, taken along section line 22 in FIG. 21.

The foregoing discussion has focused on coating the inner surface of pipe and tubing. However, the basic method of the present invention is not limited to coating the bore inside of such elongated tubular bodies. The basic principles of the method may be used to coat the inside surface of a bore in bodies of various sizes and shapes, including irregular shapes. Furthermore, the bore can be open at each end, or it may be open at one end and closed at the other end. This is illustrated by FIGS. 21 and 22, where an irregularly shaped linkage element 105 is shown. As seen in FIG. 21, the linkage element has three bores 106, 107 and 108. As seen in FIG. 22, the bores 106 and 107 are bores having two open ends, while bore 108 has one open end and one closed end. In order to coat the bores according to the present invention, the linkage element 105 must be prepared for coating by surface cleaning the bores, inserting the elongated metal wires, and sealing the bore openings. The linkage element is then placed in a first machine which rapidly rotates the linkage element about the axis of bore 106 while the bore is heated and then cooled to produce the coated surface for bore 106. The linkage element is then placed in a second machine which rapidly rotates it about the axis of bore 107 while the bore is heated and then cooled to produce the coated surface for bore 107. Finally, the linkage element is placed in a third machine which rapidly rotates it about the axis of bore 108 while the bore is heated and then cooled to produce the coated surface for bore 108.

In light of the foregoing disclosure further alternative embodiments of the inventive method and apparatus will undoubtedly suggest themselves to those skilled in the art. For example, the method and apparatus is not limited to the internal coating of a tubular body. It can also be used for heat treating or tempering a nonconcentric tube to produce a concentric heat treated tube. If tempering is needed, a quench can follow the initial induction heating which coats the internal bore of the tubular body, to be then followed by a second heating in a second induction heater to harden the final product. Similarly, the method and apparatus of the present invention is not limited to the coating of metal upon metal as herein described. It also has application to coating the bore of metal substrate with an internal lining of ceramic or plastic. Additionally, the invention has application to coating ceramic on metal or plastic, and plastic on ceramic or metal. Further, ceramic may be coated on ceramic and plastic may be coated on plastic.

It is thus intended that the disclosure be taken as illustrative only, and that it not be construed in any limiting sense. Modifications and variations may be resorted to without departing from the spirit and the scope of this invention, and such modifications and variations are considered to be within the purview and the scope of the appended claims.

What is claimed is:

1. A method for coating the inside surface of an elongated tubular body which comprises the steps of:

a) placing a plurality of elongated pieces of coating material into the bore of said elongated tubular body in parallel with the axis of said tubular body and in position within said bore to provide a substantially constant amount of coating material along the axial length of said bore, said coating material having a melting point below the melting point of said tubular body;

b) confining said elongated pieces of coating material within said bore by discrete and otherwise unconnected closure members fastened to the ends of said tubular body;

c) reducing the amount of oxygen contained within the bore of said tubular body;

d) rotating said tubular body and said confined elongated pieces of coating material at a high rotational speed sufficient to distribute said elongated pieces against the bore surface while maintaining said substantially constant amount of coating material along the axial length of said bore;

e) heating said rotating tubular body to an elevated temperature sufficient to melt said coating material pieces within said bore and insufficient to melt and said tubular body;

f) spreading melted coating material in a uniform layer upon the bore surface by means of the centrifugal force imposed upon the melted coating material by the continued rotation of said tubular body;

g) cooling said rotating tubular body with said closure members fastened to the ends of said tubular body; and, h) recovering said tubular body with a uniform layer of solid coating material upon the bore surface, and with said closure members fastened to the ends of said tubular body.

2. A method for coating according to claim 1 wherein said interior surface of said elongated tubular body is cleaned to render it substantially free of surface contaminants before placing said plurality of elongated pieces of coating material into said bore.

3. A method for coating according to claim 1 wherein at least one closure member includes a pressure relief valve for releasing expanded gas from said bore when said tubular body is heated in said heating zone.

4. A method for coating according to claim 1 wherein said pieces of coating material comprise a metal containing a flux.

5. A method for coating according to claim 1 wherein said elongated pieces of coating material are selected from the group consisting of ribbons, wires, rods, wire mesh and elongated portions of the cylindrical sidewall of a bore sleeve.

6. A method for coating according to claim 1 wherein said elongated pieces of coating material are elongated portions of the cylindrical sidewall of a bore sleeve.

7. A method for coating according to claim 1 wherein oxygen contained within said bore is reduced by imposing a vacuum on the bore to remove at least a portion of the air contained therewithin.

8. A method for coating according to claim 1 wherein oxygen contained within said bore is reduced by purging said bore with an inert gas to remove at least a portion of the air contained therewithin.

9. A method for coating according to claim 8 wherein said inert gas is selected from the group consisting of nitrogen, helium, argon, and neon.

10. A method for coating according to claim 1 wherein said uniform layer upon the bore surface of said recovered tubular body is a layer having uniform thickness.

11. A method for coating according to claim 1 wherein said uniform layer upon the bore surface of said recovered tubular body is a uniformly concentric layer.

12. A method for coating the inside surface of an elongated tubular body which comprises the steps of:

a) placing a plurality of elongated pieces of coating material into the bore of said elongated tubular body in parallel with the axis of said tubular body and in position within said bore to provide a substantially constant amount of coating material along the axial length of said bore, said coating material having a melting point below the melting point of said tubular body;

b) reducing the amount of oxygen contained within the bore of said tubular body;

c) rotating said tubular body and said elongated pieces of coating material within said bore at a high rotational speed sufficient to distribute said elongated pieces against the bore surface while maintaining said substantially constant amount of coating material along the axial length of said bore;

d) passing said rotating tubular body continuously and longitudinally without interruption through a heating zone maintained under conditions sufficient to melt said coating material pieces within said bore and insufficient to melt said tubular body;

e) spreading melted coating material in a uniform layer upon the bore surface by means of the centrifugal force imposed upon the melted coating material by the uninterrupted continued rotation of said tubular body as it passes continuously and longitudinally without interruption through said heating zone;

f) passing said rotating tubular body continuously and longitudinally from said heating zone into a cooling zone without interruption of rotation and longitudinally movement; and, g) recovering said tubular body from said cooling zone with a uniform layer of solid coating material upon the bore surface.

13. A method for coating according to claim 12 wherein said elongated pieces of coating material are confined within said bore before the oxygen reduction step by closure members placed on the ends of said tubular body.

14. A method for coating according to claim 13 wherein at least one closure member includes a pressure relief valve for releasing expanded gas from said bore when said tubular body is heated in said heating zone.

15. A method for coating according to claim 12 wherein said pieces of coating material comprise a metal containing a flux.

16. A method for coating according to claim 12 wherein said elongated pieces of coating material are selected from the group consisting of ribbons, wires, rods, wire mesh and elongated portions of the cylindrical sidewall of a bore sleeve.

17. A method for coating according to claim 12 wherein said elongated pieces of coating material are elongated portions of the cylindrical sidewall of a bore sleeve.

18. A method for coating according to claim 12 wherein oxygen contained within said bore is reduced by imposing a vacuum on the bore to remove at least a portion of the air contained therewithin.

19. A method for coating according to claim 12 wherein oxygen contained within said bore is reduced by purging said bore with an inert gas to remove at least a portion of the air contained therewithin.

20. A method for coating according to claim 19 wherein said inert gas is selected from the group consisting of nitrogen, helium, argon, and neon.

21. A method for coating according to claim 12 wherein said uniform layer upon the bore surface of said recovered tubular body is a layer having uniform thickness.

22. A method for coating according to claim 12 wherein said recovered tubular body has a uniform layer of solid coating material upon said bore surface having a high concentricity.

23. A method for coating according to claim 12 wherein said interior surface of said elongated tubular body is cleaned to render it substantially free of surface contaminants before placing said plurality of elongated pieces of coating material into said bore.

24. A method for boating according to claim 12 wherein said high rotational speed is in the range of from about 80 rpm to about 2000 rpm.

25. A method for coating the inside surface of an elongated tubular body which comprises the steps of:

a) placing a plurality of elongated pieces of coating material into the bore of said tubular body in parallel with the axis of said tubular body and in position within said bore to provide a substantially constant amount of coating material along the axial length of said bore, said coating material having a melting point below the melting point of said tubular body;

b) reducing the amount of oxygen contained within the bore of said tubular body;

c) placing said tubular body and said elongated pieces of coating material contained therewithin upon a plurality of first rollers rotatably aligned along a first axis in end-to-end orientation, and upon a plurality of second rollers rotatably aligned along a second axis in end-to-end orientation and positioned adjacent to said first rollers, with a narrow gap between said first and second rotatable rollers;

d) rotating said tubular body and said elongated pieces of coating material within said bore upon said first and second rotatable rollers at a high rotational speed sufficient to distribute said elongated pieces against the bore surface while maintaining said substantially constant amount of coating material along the axial length of said bore;

e) passing said rotating tubular body continuously and longitudinally through a heating zone maintained under conditions sufficient to melt said coating material pieces within said bore and insufficient to melt said tubular body;

f) spreading melted coating material in a uniform layer upon the bore surface by means of centrifugal force imposed upon the melted coating material by the continued rotation of said tubular body;

g) passing said rotating tubular body from said heating zone continuously and longitudinally through a cooling zone; and, h) recovering said tubular body from said cooling zone with a uniform layer of solid coating material upon the bore surface.

26. A method for coating according to claim 25 wherein said elongated pieces of coating material are confined within said bore before the oxygen reduction step by closure members placed on the ends of said tubular body.

27. A method for coating according to claim 26 wherein at least one closure member includes a pressure relief valve for releasing expanded gas from said bore when said tubular body is heated in said heating zone.

28. A method for coating according to claim 25 wherein said pieces of coating material comprise a metal containing a flux.

29. A method for coating according to claim 25 wherein said elongated pieces of coating material are selected from the group consisting of ribbons, wires, rods, wire mesh and elongated portions of the cylindrical sidewall of a bore sleeve.

30. A method for coating according to claim 25 wherein said elongated pieces of coating material are elongated portions of the cylindrical sidewall of a bore sleeve.

31. A method for coating according to claim 25 wherein oxygen contained within said bore is reduced by imposing a vacuum on the bore to remove at least a portion of the air contained therewithin.

32. A method for coating according to claim 25 wherein oxygen contained within said bore is reduced by purging said bore with an inert gas to remove at least a portion of the air contained therewithin.

33. A method for coating according to claim 25 wherein said inert gas is selected from, the group consisting of nitrogen, helium, argon, and neon.

34. A method for coating according to claim 25 wherein said recovered tubular body has a uniform layer of solid coating material upon said bore surface having a high concentricity.

35. A method for coating according to claim 25 wherein said interior surface of said elongated tubular body is cleaned to render it substantially free of surface contaminants before placing said plurality of elongated pieces of coating material into said bore.

36. A method for coating according to claim 25 wherein said high rotational speed is in the range of from about 800 rpm to about 2000 rpm.

37. A method for coating according to claim 25 wherein said first and second rollers are rotated in synchronization and in the same direction to rotate said tubular body.

38. A method for coating the inside surface of an elongated tubular body which comprises the steps of:

a) placing a plurality of elongated pieces of coating material into the bore of said tubular body in parallel with the axis of said tubular body and in position within said bore to provide a substantially constant amount of coating material along the axial length of said bore, said coating material having a melting point below the melting point of said tubular body;

b) reducing the amount of oxygen contained within the bore of said tubular body;

c) placing said tubular body and said elongated pieces of coating material contained therewithin upon a plurality of first rollers rotatably aligned along a first axis in end-to-end orientation, and upon a plurality of second rollers rotatably aligned along a second axis in end-to-end orientation and positioned adjacent to said first rollers, with a narrow gap between said first and second rotatable rollers;

d) rotating said tubular body and said elongated pieces of coating material within said bore upon said first and second rotatable rollers at a high rotational speed sufficient to distribute said elongated pieces against the bore surface while maintaining said substantially constant amount of coating material along the axial length of said bore;

e) passing said rotating tubular body by means of a pushing element axially continuously upon said first and second rotating rollers into and through a heating zone maintained under conditions sufficient to melt said coating material pieces within said bore and insufficient to melt said tubular body;

f) spreading melted coating material in a uniform layer upon the bore surface by means of centrifugal force imposed upon the melted coating material by the continued rotation of said tubular body;

g) passing said rotating tubular body by means of said pushing element from said heating zone into and through a cooling zone; and, h) recovering said tubular body from said cooling zone with a uniform layer of solid coating material upon the bore surface.

39. A method for coating according to claim 38 wherein said elongated pieces of coating material are confined within said bore before the oxygen reducing step by closure members placed on the ends of said tubular body.

40. A method for coating according to claim 39 wherein at least one closure member includes a pressure relief valve for releasing expanded inert gas from said bore when said tubular body is heated in said heating zone.

41. A method for coating according to claim 38 wherein said pieces of coating material comprise a metal containing a flux.

42. A method for coating according to claim 38 wherein said elongated pieces of coating material are selected from the group consisting of ribbons, wires, rods, wire mesh and elongated portions of the cylindrical sidewall of a bore sleeve.

43. A method for coating according to claim 38 wherein said elongated pieces of coating material are elongated portions of the cylindrical sidewall of a bore sleeve.

44. A method for coating according to claim 38 wherein oxygen contained within said bore is reduced by imposing a vacuum on the bore to remove at least a portion of the air contained therewithin.

45. A method for coating according to claim 38 wherein oxygen contained within said bore is reduced by purging said bore with an inert gas to remove at least a portion of the air contained therewithin.

46. A method for coating according to claim 45 wherein said inert gas is selected from the group consisting of nitrogen, helium, argon, and neon.

47. A method for coating according to claim 38 wherein said uniform layer upon the bore surface of said recovered tubular body is a layer having uniform thickness.

48. A method for coating according to claim 38 wherein said recovered tubular body has a uniform layer of solid coating material upon said bore surface having a high concentricity.

49. A method for coating according to claim 38 wherein said interior surface of said elongated tubular body is cleaned to render it substantially free of surface contaminants before placing said plurality of elongated pieces of coating material into said bore.

50. A method for coating according to claim 38 wherein said high rotational speed is in the range of from about 800 rpm to about 2000 rpm.

51. A method for coating according to claim 38 wherein said first and second rollers are rotated in synchronization and in the same direction to rotate said tubular body.

52. Coating apparatus for coating the interior of an elongated tubular body which comprises:

a) a plurality of first rollers rotatably aligned along a first rotational axis in end-to-end orientation, said plurality of first rollers having an input end and an output end;

b) a plurality of second rollers rotatably aligned along a second rotational axis in end-to-end orientation and positioned adjacent to said plurality of first rollers with a narrow gap therebetween, said plurality of second rollers having an input end adjacent the input end of said first rollers and an output end adjacent the output end of said first rollers;

c) heating means centrally located at said first and second rollers for heating an elongated tubular body supported on said rollers;

d) roller motive means for rotating said first and second rollers in synchronization and in a common direction for rotating an elongated tubular body supported on said rollers;

e) a pusher element for pushing a rotating tubular body longitudinally upon said first and second rollers as said tubular body rotates thereon;

f) a pusher motive means for moving the pusher element to slide a rotating tubular body from the input end of said first and second rollers through a heating zone comprising said heating means and to the output end of said first and second rollers; and, g) reciprocating means for returning said pusher element to the input end of said first and second rollers

53. Coating apparatus according to claim 52 wherein said first and second rollers are located at the heating zone with a greater concentration of end-to-end rollers and a smaller dimension between end-to-end rollers, and as the distance from the heating zone to the input and the output ends of the pluralities of rollers increases, the concentration of rollers decreases and the dimension between end-to-end rollers increases.

54. Coating apparatus according to claim 52 wherein said heating means comprises an induction heater around a portion of said first and second of rollers.

55. A method for coating according to claim 1 wherein said high rotational speed is in the range of from about 800 rpm to about 2000 rpm.

56. A method for coating according to claim 25 wherein said uniform layer upon the bore surface of said recovered tubular body is a layer having uniform thickness.

57. A method for coating the inside surface of an elongated tubular body which comprises the steps of:

a) placing a plurality of elongated pieces of coating material into the bore of said elongated tubular body in parallel with the axis of said tubular body and in position within said bore to provide a substantially constant amount of coating material along the axial length of said bore, said coating material having a melting point below the melting point of said tubular body;

b) reducing the amount of oxygen contained within the bore of said tubular body:

c) rotating said tubular body and said elongated pieces of coating material within said bore at a high rotational speed sufficient to distribute said elongated pieces against the bore surface while maintaining said substantially constant amount of coating material along the axial length of said bore;

d) passing a heating means over said rotating tubular body, said heating means being passed from a first end to a second end of said tubular body, and said heating means being maintained under conditions sufficient to melt said coating material pieces within said bore and insufficient to melt said tubular body;

e) spreading melted coating material in a uniform layer upon the bore surface by means of the centrifugal force imposed upon the melted coating material by the continued rotation of said tubular body; and, f) recovering said tubular body with a uniform layer of solid coating material upon the bore surface when said heating means has passed beyond the second end of said tubular body.

58. A method for coating according to claim 57 wherein said elongated pieces of coating material are confined within said bore before the oxygen reduction step by closure members placed on the ends of said tubular body.

59. A method for coating according to claim 58 wherein at least one closure member includes a pressure relief valve for releasing expanded gas from said bore when said tubular body is heated in said heating zone.

60. A method for coating according to claim 57 wherein said pieces of coating material comprise a metal containing a flux.

61. A method for coating according to claim 57 wherein said elongated pieces of coating material are selected from the group consisting of ribbons, wires, rods, wire mesh and elongated portions of the cylindrical sidewall of a bore sleeve.

62. A method for coating according to claim 57 wherein said elongated pieces of coating material are elongated portions of the cylindrical sidewall of a bore sleeve.

63. A method for coating according to claim 57 wherein oxygen contained within said bore is reduced by imposing a vacuum on the bore to remove at least a portion of the air contained therewithin.

64. A method for coating according to claim 57 wherein oxygen contained within said bore is reduced by purging said bore with an inert gas to remove at least a portion of the air contained therewithin.

65. A method for coating according to claim 64 wherein said inert gas is selected from the group consisting of nitrogen, helium, argon, and neon.

66. A method for coating according to claim 57 wherein said uniform layer upon the bore surface of said recovered tubular body is a layer having uniform thickness.

67. A method for coating according to claim 57 wherein said uniform layer upon the bore surface of said recovered tubular body is a uniformly concentric layer.

68. A method for coating according to claim 57 wherein said interior surface of said elongated tubular body is cleaned to render it substantially free of surface contaminants before placing said plurality of elongated pieces of coating material into said bore.

69. A method for coating according to claim 57 wherein said high rotational speed is in the range of from about 800 rpm to about 2000 rpm.

70. A method for coating the inside surface of an elongated tubular body which comprises the steps of:

a) placing a plurality of elongated pieces of coating material into the bore of said tubular body in parallel with the axis of said tubular body and in position within said bore to provide a substantially constant amount of coating material along the axial length of said bore, said coating material having a melting point below the melting point of said tubular body;

b) reducing the amount of oxygen contained within the bore of said tubular body;

c) placing said tubular body and said elongated pieces of coating material contained therewithin upon a plurality of first rollers rotatably aligned along a first axis in end-to-end orientation, and upon a plurality of second rollers rotatably aligned along a second axis in end-to-end orientation and positioned adjacent to said first rollers, with a narrow gap between said first and second rotatable rollers;

d) rotating said tubular body and said elongated pieces of coating material within said bore upon said first and second rotatable rollers at a high rotational speed sufficient to distribute said elongated pieces against the bore surface while maintaining said substantially constant amount of coating material along the axial length of said bore;

e) passing a heating means alongside said rotating tubular body, said heating means being passed from a first end to a second end of said tubular body, and said heating means being maintained under conditions sufficient to melt said coating material pieces within said bore and insufficient to melt said tubular body;

f) spreading melted coating material in a uniform layer upon the bore surface by means of the centrifugal force imposed upon the melted coating material by the continued rotation of said tubular body; and, g) recovering said tubular body with a uniform layer of solid coating material upon the bore surface when said heating means has passed beyond the second end of said tubular body.

71. A method for coating according to claim 70 wherein said elongated pieces of coating material are confined within said bore before the oxygen reduction step by closure members placed on the ends of said tubular body.

72. A method for coating according to claim 71 wherein at least one closure member includes a pressure relief valve for releasing expanded gas from said bore when said tubular body is heated in said heating zone.

73. A method for coating according to claim 70 wherein said pieces of coating material comprise a metal containing a flux.

74. A method for coating according to claim 70 wherein said elongated pieces of coating material are selected from the group consisting of ribbons, wires, rods, wire mesh and elongated portions of the cylindrical sidewall of a bore sleeve.

75. A method for coating according to claim 70 wherein said elongated pieces of coating material are elongated portions of the cylindrical sidewall of a bore sleeve.

76. A method for coating according to claim 70 wherein oxygen contained within said bore is reduced by imposing a vacuum on the bore to remove at least a portion of the air contained therewithin.

77. A method for coating according to claim 70 wherein oxygen contained within said bore is reduced by purging said bore with an inert gas to remove at least a portion of the air contained therewithin.

78. A method for coating according to claim 77 wherein said inert gas is selected from the group consisting of nitrogen, helium, argon, and neon.

79. A method for coating according to claim 70 wherein said uniform layer upon the bore surface of said recovered tubular body is a layer having uniform thickness.

80. A method for coating according to claim 70 wherein said uniform layer upon the bore surface of said recovered tubular body is a uniformly concentric layer.

81. A method for coating according to claim 70 wherein said interior surface of said elongated tubular body is cleaned to render it substantially free of surface contaminants before placing said plurality of elongated pieces of coating material into said bore.

82. A method for coating according to claim 70 wherein said high rotational speed is in the range of from about 800 rpm to about 2000 rpm.

83. Coating apparatus for coating the interior of an elongated tubular body which comprises:

a) a plurality of first rollers rotatably aligned along a first rotational axis in end-to-end orientation, said plurality of first rollers having a first end and a second end;

b) a plurality of second rollers rotatably aligned along a second rotational axis in end-to-end orientation and positioned adjacent to said first rollers with a first gap therebetween, said plurality of second rollers having a first end adjacent the first end of said first rollers and a second and adjacent the second end of said first rollers;

c) movable heating means located at said first end of said first and second rollers for heating an elongated first tubular body supported on said rollers;

d) roller motive means for rotating said first and second rollers in synchronization and in a common direction for rotating an elongated first tubular body supported on said first and second rollers;

e) a heater motive means for moving said movable heating means longitudinally alongside a first tubular body and said first and second rollers as said first tubular body rotates thereon; and, f) means for returning said heating means to the first end of said first and second rollers when said heating means reaches the second end of said first and second rollers.

84. Coating apparatus according to claim 83 wherein said heating means comprises an induction heater.

85. Coating apparatus according to claim 83 wherein said heating means is movable over said first tubular body.

86. Coating apparatus according to claim 83 further including a plurality of third rollers rotatably aligned along a third rotational axis in end-to-end orientation and positioned adjacent to said second rollers with a narrow second gap between said second and third rollers; said plurality of third rollers having a first end adjacent the first end of said second rollers and a second end adjacent the second end of said second rollers; said first, second and third axes defining a common plane; and said movable heating means being longitudinally movable alongside a second tubular body and said second and third rollers as said second tubular body rotates thereon.

87. Coating apparatus according to claim 86 wherein said heating means comprises a first induction heater for heating said first tubular body and a second induction heater for heating said second tubular body.

88. Coating apparatus according to claim 86 wherein said movable heating means is movable over said first and second tubular bodies.

89. Coating apparatus according to claim 83 further including a plurality of third rollers rotatably aligned along a third rotational axis in end-to-end orientation and positioned adjacent said second rollers with a second gap between said second and third rollers; a plurality of fourth rollers rotatably aligned along a fourth rotational axis in end-to-end orientation and positioned adjacent to said third rollers with a third gap between said third and fourth rollers; said plurality of third rollers having a first end adjacent the first end of said second rollers and a second end adjacent the second end of said second rollers; said plurality of fourth rollers having a first end adjacent the first end of said third rollers and a second end adjacent the second end of said third rollers; said first, second, third and fourth axes defining a common plane; and said movable heating means being longitudinally movable alongside a second tubular body and said third and fourth rollers as said second tubular body rotates thereon.

90. Coating apparatus according to claim 89 wherein said heating means comprises a first induction heater for heating said first tubular body and a second induction heater for heating said second tubular body.

91. Coating apparatus according to claim 89 wherein said heating means is movable over said first and second tubular bodies.

92. A method for coating the inside surface of a bore contained within a substrate body which comprises the steps of:

a) placing a plurality of elongated pieces of coating material into the bore of said substrate body in parallel with the axis of said bore and in position within said bore to provide a substantially constant amount of coating material along the axial length of said bore, said coating material having a melting point below the melting point of said substrate body;

b) confining said elongated pieces of coating material within said bore by at least one discrete and otherwise unconnected closure member fastened to said substrate body;

c) reducing the amount of oxygen contained within the bore of said substrate body;

d) rotating said substrate body, and said elongated pieces of coating material within said bore, about the bore axis, at a high rotational speed sufficient to distribute said elongated pieces against the bore surface while maintaining said substantially constant amount of coating material along the axial length of said bore;

e) heating said rotating substrate body to an elevated temperature sufficient to melt said coating material pieces within said bore and insufficient to melt said substrate body;

f) spreading melted coating material in a uniform layer upon the bore surface by means of the centrifugal force imposed upon the melted coating material by the continued rotation of said substrate body;

g) cooling said rotating substrate body with said at least one closure member fastened to said substrate body; and, h) recovering said substrate body with said at least one closure member fastened to said substrate body, and with a uniform layer of solid coating material upon the bore surface.

93. A method for coating according to claim 92, wherein said at least one closure member includes a pressure relieve valve for releasing expanded gas from said bore when said substrate body is heated in said heating zone.

94. A method for coating according to claim 92 wherein said pieces of coating material comprise a metal containing a flux.

95. A method for coating according to claim 92 wherein said elongated pieces of coating material are selected from the group consisting of ribbons, wires, rods, wire mesh and elongated portions of the cylindrical sidewall of a bore sleeve.

96. A method for coating according to claim 92 wherein said elongated pieces of coating material are elongated portions of the cylindrical sidewall of a bore sleeve.

97. A method for coating according to claim 92 wherein oxygen contained within said bore is reduced by imposing a vacuum on the bore to remove at least a portion of the air contained therewithin.

98. A method for coating according to claim 92 wherein oxygen contained within said bore is reduced by purging said bore with an inert gas to remove at least a portion of the air contained therewithin.

99. A method for coating according to claim 98 wherein said inert gas is selected from the group consisting of nitrogen, helium, argon, and neon.

100. A method for coating according to claim 92 wherein said uniform layer upon the bore surface of said recovered substrate body is a layer having uniform thickness.

101. A method for coating according to claim 92 wherein said uniform layer upon the bore surface of said recovered substrate body is a uniformly concentric layer.

102. A method for coating according to claim 92 wherein said bore has one open end and one closed end.

103. Coating apparatus according to claim 52 wherein said first and second rollers are located at the heating zone with a greater concentration of end-to-end rollers and a smaller dimension between end-to-end rollers, and as the distance from the heating zone to the output end of the pluralities of rollers increases, the concentration of rollers decreases and the dimension between end-to-end rollers increases.

104. Coating apparatus according to claim 52 wherein said plurality of second rollers is movable relative to said plurality of first rollers to adjust the width of said gap for supporting different sizes of tubular bodies upon said first and second rollers.

105. Coating apparatus according to claim 83 wherein said plurality of second rollers is movable relative to said plurality of first rollers to adjust the width of said gap for supporting different sizes of tubular bodies upon said first and second rollers.

106. Coating apparatus according to claim 86 wherein said heating means comprises a first heating unit for heating said first tubular body and a second heating unit for heating said second tubular body, a first temperature control means for activating said first heating unit to heat a first rotating tubular body as said heating means is moved in a first direction and for deactivating said first heating unit as said heating means is returned in a second direction, and a second temperature control means for activating said second heating unit to heat a second rotating tubular body as said heating means is returned in said second direction and for deactivating said second heating unit when said heating means is moved in said first direction.

107. Coating apparatus according to claim 89 wherein said heating means comprises a first heating unit for heating said first tubular body and a second heating unit for heating said second tubular body, a first temperature control means for activating said first heating unit to heat a first rotating tubular body as said heating means is moved in a first direction and for deactivating said first heating unit as said heating means is returned in a second direction, and a second temperature control means for activating said second heating unit to heat a second rotating tubular body as said heating means is returned in said second direction and for deactivating said second heating unit when said heating means is moved in said first direction.

108. A method for coating the inside surface of elongated tubular bodies when comprises the steps of:

a) placing a plurality of elongated pieces of coating material into the bores of first and second elongated tubular bodies in parallel with the axes of said first and second tubular bodies and in position within said bores to provide a substantially constant amount of coating material along the axial length of each said bore, said coating material having a melting point below the melting point of said tubular bodies;

b) rotating said first and second tubular bodies axially adjacent each other, and thereby rotating said elongated pieces of coating material within each said bore, at a high rotational speed sufficient to distribute said elongated pieces against each bore surface while maintaining said substantially constant amount of coating material along the axial length of each said bore;

c) passing a heating means along said rotating tubular bodies, said heating means being passed from a first end to a second end of said tubular bodies, and said heating means being maintained under conditions sufficient to melt said coating material pieces within at least one of said bores and insufficient to melt and said tubular bodies;

d) spreading melted coating material in a uniform layer upon the bore surface of said at least one of said bores by means of the centrifugal force imposed upon the melted coating material by the continued rotation of said tubular bodies; and, e) recovering said first and second tubular bodies with a uniform layer of solid coating material upon each bore surface after said heating means has passed beyond the second end of said tubular bodies.

109. A method according to claim 108 wherein said first tubular body is recovered with said uniform layer when said heating means has been passed from said second end back to said first end, and said second tubular body is recovered with said uniform layer when said heating means has been passed from said first end to said second end for a second time.

110. A method according to claim 108 wherein the amount of oxygen contained within the bore of each said tubular body is reduced before said tubular bodies are rotated.

111. A method according to claim 108 wherein said heating means maintains said melting conditions upon said first rotating tubular body while being passed from said first end to said second end, said heating means is deactivated to terminate said melting conditions for said first rotating tubular body when it has passed beyond said second end of said tubular bodies, said heating means is then passed from said second and back to said first end of said tubular bodies while maintaining said melting conditions upon said second rotating tubular body, said heating means is deactivated to terminate said melting conditions for said second rotating tubular body when it has passed beyond said first end of said tubular bodies, and said first tubular body is then recovered with said uniform layer of solid coating material upon its bore surface.

112. A method according to claim 111 wherein said recovered first tubular body is replaced by a rotating replacement first tubular body containing elongated pieces of coating material within its bore, said heating means is passed from said first end to said second end of said tubular bodies while maintaining said melting conditions upon said rotating replacement first tubular body, said heating means is then deactivated to terminate said melting conditions for said rotating replacement first tubular body when it has passed beyond the second end of said tubular bodies, and said second tubular body is then recovered with said uniform layer of solid coating material upon its bore surface.

113. A method according to claim 112 wherein said recovered second tubular body is replaced by a rotating replacement second tubular body containing elongated pieces of coating material with its bore, said heating means is reciprocated back and forth to alternately heat one of said rotating replacement first and second tubular bodies while the other replacement tubular body is cooled, and cooled other replacement tubular body is recovered and a new replacement tubular body is rotated in its place, the heating means then is passed in the reverse direction to heat the new replacement tubular body while the previously heated replacement tubular body is cooled, and at the end of each reciprocating pass an internally coated tubular body is recovered and replaced by another new replacement rotating tubular body in a continuing process.

114. A method for coating the inside surface of elongated tubular bodies which comprises the steps of:

a) placing a plurality of elongated pieces of coating material into the bores of first and second tubular bodies in parallel with the axes of said first and second tubular bodies and in position within said bores to provide a substantially constant amount of coating material along the axial length of each said bore, said coating material having a melting point below the melting point of said tubular bodies;

b) placing said first tubular body and said elongated pieces of coating material contained therewithin upon a plurality of first rollers rotatably aligned a first axis in end-to-end orientation, and upon a plurality of second rollers rotatably aligned along a second axis in end-to-end orientation and positioned adjacent to said first rollers, with a narrow gap between said first and second rotatable rollers;

c) placing said second tubular body and said elongated pieces of coating material contained therewithin upon a plurality of third rollers rotatably aligned along a third axis in end-to-end orientation, and upon a plurality of fourth rollers rotatably aligned along a fourth axis in end-to-end orientation and positioned adjacent to said third rollers, with a narrow gap between said third and fourth rotatable rollers, with said third rollers being aligned and spaced from said second rollers;

d) rotating said first and second tubular bodies and said elongated pieces of coating material contained within each said bore upon said rotatable rollers at a high rotational speed sufficient to distribute said elongated pieces against each bore surface while maintaining said substantially constant amount of coating material along the axial length of each said bore;

e) passing a heating means alongside said first and second rotating tubular bodies, said heating means being passed from a first end to a second end of said tubular bodies, and said heating means being maintained under conditions sufficient to melt said coating material pieces within the bore of only said first tubular body and insufficient to melt said first tubular body;

f) spreading melted coating material in a uniform layer upon the bore surface of said first tubular body by means of the centrifugal force imposed upon the melted coating material by the continued rotation of said first tubular body;

g) terminating the heating conditions on said first tubular body when said heating means has passed beyond said second end and continuing to rotate said first tubular body as it cools;

h) passing said heating means alongside said rotating tubular bodies from said second end to said first end of said tubular bodies with said heating means being maintained under conditions sufficient to melt said coating material pieces within the bore of only said second tubular body and insufficient to melt said second tubular body;

i) spreading melted coating material in a uniform layer upon the bore surface of said second tubular body by means of the centrifugal force imposed upon the melted coating material by the continued rotation of said second tubular body;

j) terminating the heating conditions on said second tubular body when said heating means has passed beyond said first end and continuing to rotate said second tubular body as it cools; and, k) recovering said first tubular body with a uniform layer of solid coating material upon the bore surface when said heating means has passed beyond the first end of said tubular body.

115. A method according to claim 114 wherein the amount of oxygen contained within the bore of each said tubular body is reduced before said tubular bodies are rotated upon said rotatable rollers.

116. A method according to claim 114 wherein said recovered first tubular body is replaced by a replacement first tubular body containing elongated pieces of coating material within its bore, said replacement first tubular body is rotated upon said first and second rollers, said heating means is passed from said first end to said second end of said tubular bodies while maintaining said melting conditions upon only said rotating replacement first tubular body, said heating means is then deactivated to terminate said melting conditions for said rotating replacement first tubular body when it has passed beyond the second end of said tubular bodies, and said second tubular body is then recovered with a uniform layer of solid coating material upon its bore surface.

117. A method according to claim 116 wherein said recovered second tubular body is replaced by a replacement second tubular body containing elongated pieces of coating material within its bore, said replacement second tubular body is rotated upon said third and fourth rollers; said heating means is reciprocated back and forth to alternately heat one of said rotating replacement first and second tubular bodies while the other replacement tubular body is cooled, the cooled other replacement tubular body is recovered and a new replacement tubular body is rotated in its place, the heating means then is passed in the reverse direction to heat the new replacement tubular body while the previously heating replacement tubular body is cooled, and at the end of each reciprocating pass an internally coated tubular body is recovered and replaced by another new replacement tubular body in a continuing process.

* * * * *

UNITED STATES PATENT AND TRADEMARK OFFICE

CERTIFICATE OF CORRECTION

PATENT NO. : 5,059,453

DATED : October 22, 1991

INVENTOR(S) : Philip Bernstein, Jr.

It is certified that error appears in the above-identified patent and that said Letters Patent is hereby corrected as shown below:

Title Page, Col. 1, [22] Filing Date, change the filing date from "Oct. 30, 1990" to --March 8, 1990--.

Title Page, Col. 1, [75] + top, change inventor's name from "Philip Bernsten, Jr." to --Philip Bernstein, Jr.--.

Title Page, Col. 1 [56] 17th ref., change "Susgi" to --Susai--.

Col. 5, line 57, change "parallely" to --parallel--.

Col. 6, line 21, change "parallely" to --parallel--.

Col. 6, line 47, change "o" to --of--.

Col. 8, line 4, change "22" to --22-22--.

Col. 8, line 18, change "a" to --an--.

Col. 10, line 62, change "ar" to --are--.

Col. 11, line 11, change "parallely" to --parallel--.

Col. 15, line 54, change "of" to --off--.

Col. 15, line 57, change "8" to --86--.

Col. 17, line 20, after "hand" insert a comma.

Claim 1, Col. 18, line 44, after "melt" delete "and".

Claim 12, Col. 19, line 59-60, change "longitudinally" to --longitudinal--.

Claim 24, Col. 20, line 42, change "boating" to --coating--.

UNITED STATES PATENT AND TRADEMARK OFFICE

CERTIFICATE OF CORRECTION

PATENT NO. : 5,059,453

DATED : October 22, 1991

INVENTOR(S) : Philip Bernstein, Jr.

It is certified that error appears in the above-identified patent and that said Letters Patent is hereby corrected as shown below:

Claim 24, Col. 20, line 44, change "80" to --800--.

Claim 33, Col. 21, line 49, after "from" delete the comma.

Claim 54, Col. 23, line 68, after "second" delete "of".

Claim 93, Col. 28, line 28, change "relieve" to --relief--.

Claim 108, Col. 29, line 44, change "when" to --which--.

Claim 108, Col. 29, line 68, after "melt" delete "and".

Claim 111, Col. 30, line 29, after "second" change "and" to --end--.

Claim 113, Col. 30, line 54, change "with" to --within--.

Claim 113, Col. 30, line 58, change "and" to --the--.

Claim 114, Col. 31, line 11, after "aligned" insert --along--.

UNITED STATES PATENT AND TRADEMARK OFFICE

CERTIFICATE OF CORRECTION

PATENT NO. : 5,059,453

DATED : October 22, 1991

INVENTOR(S) : Philip Bernstein, Jr.

It is certified that error appears in the above-identified patent and that said Letters Patent is hereby corrected as shown below:

Claim 114, Column 31, line 26, change "aligned" to --alongside--.

Signed and Sealed this

Thirteenth Day of April, 1993

*Attest:*

STEPHEN G. KUNIN

*Attesting Officer*

*Acting Commissioner of Patents and Trademarks*